US009958802B2

(12) United States Patent
Kikuchi et al.

(10) Patent No.: US 9,958,802 B2
(45) Date of Patent: May 1, 2018

(54) ELECTROCONDUCTIVE MEMBER FOR ELECTROPHOTOGRAPHY, PROCESS CARTRIDGE, AND ELECTROPHOTOGRAPHIC APPARATUS

(71) Applicant: CANON KABUSHIKI KAISHA, Tokyo (JP)

(72) Inventors: Yuichi Kikuchi, Susono (JP); Kazuhiro Yamauchi, Suntou-gun (JP); Norifumi Muranaka, Yokohama (JP); Tetsuo Hino, Yamato (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/543,656

(22) PCT Filed: Mar. 23, 2016

(86) PCT No.: PCT/JP2016/060284
§ 371 (c)(1),
(2) Date: Jul. 14, 2017

(87) PCT Pub. No.: WO2016/159033
PCT Pub. Date: Oct. 6, 2016

(65) Prior Publication Data

US 2018/0024459 A1 Jan. 25, 2018

(30) Foreign Application Priority Data

Mar. 27, 2015 (JP) ..... 2015-066841

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS 4,922,299 A 5/1990 Uchimoto et al.
8,298,670 B2 10/2012 Muranaka et al.
(Continued)

FOREIGN PATENT DOCUMENTS

JP 2004-037786 2/2004
JP 2006-091495 4/2006
(Continued)

*Primary Examiner* — Sandra Brase
(74) *Attorney, Agent, or Firm* — Fitzpatrick Cella Harper and Scinto

(57) ABSTRACT

Provided is an electroconductive member for electrophotography capable of charging an electrically chargeable body stably over a long period of time. The electroconductive member includes an electroconductive support and a surface layer on the electroconductive support. The surface layer has a skeleton that is three-dimensionally continuous and a pore that communicates in a thickness direction, and when any region measuring 150 μm per side of a surface of the surface layer is photographed and equally divided into 60 parts in a vertical direction and 60 parts in a horizontal direction to form 3,600 squares, the number of squares including through holes is 100 or less. The skeleton is non-electroconductive and includes a plurality of particles connected to each other through a neck, and an average value D1 of circle-equivalent diameters of the particles is 0.1 μm or more and 20 μm or less.

9 Claims, 7 Drawing Sheets

(56) References Cited

U.S. PATENT DOCUMENTS

| | | | | |
|---|---|---|---|---|
| 8,449,975 | B2 | 5/2013 | Hirakoso et al. | |
| 8,628,854 | B2 | 1/2014 | Yamauchi et al. | |
| 8,715,830 | B2 | 5/2014 | Yamada et al. | |
| 8,771,818 | B2 | 7/2014 | Nishioka et al. | |
| 8,852,743 | B2 | 10/2014 | Kikuchi et al. | |
| 9,023,465 | B2 | 5/2015 | Yamada et al. | |
| 9,086,643 | B2 | 7/2015 | Kikuchi et al. | |
| 9,128,403 | B2 | 9/2015 | Yamauchi et al. | |
| 9,146,482 | B2 | 9/2015 | Watanabe et al. | |
| 9,360,789 | B1 | 6/2016 | Masu et al. | |
| 9,442,408 | B2 | 9/2016 | Yamauchi et al. | |
| 9,442,451 | B2 | 9/2016 | Yamauchi et al. | |
| 9,541,854 | B2 | 1/2017 | Kikuchi et al. | |
| 9,547,250 | B2 | 1/2017 | Kikuchi et al. | |
| 9,551,949 | B2 | 1/2017 | Yamauchi et al. | |
| 9,581,931 | B2 | 2/2017 | Yamada et al. | |
| 9,599,913 | B2 | 3/2017 | Nishioka et al. | |
| 9,639,009 | B2 | 5/2017 | Yamaguchi et al. | |
| 9,651,888 | B2 | 5/2017 | Muranaka et al. | |
| 9,665,028 | B2 | 5/2017 | Arimura et al. | |
| 9,665,029 | B2 | 5/2017 | Hino et al. | |
| 9,740,133 | B2 | 8/2017 | Yamauchi et al. | |
| 2002/0015601 | A1* | 2/2002 | Ishiyama ..... | G03G 15/0233 399/176 |
| 2002/0106216 | A1 | 8/2002 | Ishiyama et al. | |
| 2002/0197082 | A1 | 12/2002 | Hosokawa et al. | |
| 2003/0219282 | A1* | 11/2003 | Satoh ..... | G03G 15/0233 399/174 |
| 2006/0226572 | A1 | 10/2006 | Tanaka et al. | |
| 2012/0308261 | A1 | 12/2012 | Tsuru et al. | |
| 2013/0216286 | A1* | 8/2013 | Hasegawa ..... | G03G 21/0094 399/346 |
| 2013/0281276 | A1 | 10/2013 | Watanabe et al. | |
| 2015/0198900 | A1 | 7/2015 | Yamada et al. | |
| 2015/0331339 | A1 | 11/2015 | Yamada et al. | |
| 2015/0331340 | A1 | 11/2015 | Nishioka et al. | |
| 2015/0331342 | A1 | 11/2015 | Yamaguchi et al. | |
| 2015/0331346 | A1 | 11/2015 | Yamauchi et al. | |
| 2015/0331347 | A1 | 11/2015 | Arimura et al. | |
| 2016/0054674 | A1 | 2/2016 | Muranaka et al. | |
| 2016/0154323 | A1 | 6/2016 | Nishioka et al. | |
| 2016/0187801 | A1 | 6/2016 | Yamada et al. | |
| 2016/0187809 | A1 | 6/2016 | Yamaguchi et al. | |
| 2017/0210719 | A1 | 7/2017 | Nishioka et al. | |

FOREIGN PATENT DOCUMENTS

| | | |
|---|---|---|
| JP | 2008-276026 | 11/2008 |
| JP | 2010-244816 | 10/2010 |

* cited by examiner

ELECTROCONDUCTIVE MEMBER FOR ELECTROPHOTOGRAPHY, PROCESS CARTRIDGE, AND ELECTROPHOTOGRAPHIC APPARATUS

TECHNICAL FIELD

The present invention relates to an electroconductive member for electrophotography, a process cartridge, and an electrophotographic apparatus.

BACKGROUND ART

In an electrophotographic image forming apparatus (hereinafter sometimes referred to as "electrophotographic apparatus"), there has been used an electroconductive member for electrophotography, such as a charging member. It is required for the charging member for charging the surface of an electrically chargeable body, such as an electrophotographic photosensitive member to be brought into contact with the electrically chargeable body, to stably charge the electrically chargeable body over a long period of time.

In PTL 1, there is a disclosure of a charging member in which a charging defect and a degradation in charging ability caused by dirt on the surface are less liable to occur even in the case of repeated use over a long period of time. Specifically, there is a disclosure of a charging member having a convex portion, which is derived from electroconductive resin particles, formed on a surface layer of the charging member.

Further, in PTL 2, there is a disclosure of a charging roll including an electroconductive covering member having a surface free energy of 30 mN/m or more and a layer of organic fine particles or inorganic fine particles, each having a particle diameter of 3.0 μm or less, formed on an entire surface of the electroconductive covering member.

CITATION LIST

Patent Literature

PTL 1: Japanese Patent Application Laid-Open No. 2008-276026

PTL 2: Japanese Patent Application Laid-Open No. 2006-91495

SUMMARY OF INVENTION

Technical Problem

The present invention is directed to providing an electroconductive member for electrophotography capable of stably charging an electrically chargeable body. The present invention is also directed to providing a process cartridge and an electrophotographic image forming apparatus configured to form an electrophotographic image of high quality.

Solution to Problem

According to one embodiment of the present invention, there is provided an electroconductive member for electrophotography, including:

an electroconductive support; and a surface layer on the electroconductive support, in which the surface layer includes a skeleton that is three-dimensionally continuous and a pore that communicates in a thickness direction, in which, when any region measuring 150 μm per side of a surface of the surface layer is photographed and equally divided into 60 parts in a vertical direction and 60 parts in a horizontal direction to form 3,600 squares, the number of squares including through holes is 100 or less, in which the skeleton is non-electroconductive, and in which the skeleton includes a plurality of particles connected to each other through a neck, and an average value D1 of circle-equivalent diameters of the particles is 0.1 μm or more and 20 μm or less.

According to another embodiment of the present invention, there is provided a process cartridge, which is removably mounted onto a main body of an electrophotographic apparatus, the process cartridge including the electroconductive member.

According to still another embodiment of the present invention, there is provided an electrophotographic apparatus, including the electroconductive member.

Advantageous Effects of Invention

According to the present invention, the electroconductive member for electrophotography capable of stably charging an electrically chargeable body can be provided. According to the present invention, the process cartridge and the electrophotographic apparatus configured to stably form an electrophotographic image of high quality can be provided.

Further features of the present invention will become apparent from the following description of exemplary embodiments with reference to the attached drawings.

DESCRIPTION OF EMBODIMENTS

Preferred embodiments of the present invention will now be described in detail in accordance with the accompanying drawings.

The inventors of the present invention have made investigations on the charging members according to PTL 1 and PTL 2, and as a result, have confirmed that the charging members have an effect of suppressing adhesion of a toner and an external additive. However, in recent years, along with an increase in resolution of an electrophotographic image, a charging voltage to be applied between the charging member and an electrically chargeable body tends to increase. That is, when the charging voltage is increased, a developing contrast can be increased, with the result that a gray scale of color can be increased.

However, when the charging voltage is increased, abnormal discharge, in which a discharged charge amount is increased locally, is liable to occur. Under a low-temperature and low-humidity environment, abnormal discharge is particularly liable to occur.

(Dirt)

Further, it has been confirmed that the charging members according to PTL 1 and PTL 2 can suppress physical adhesion of a toner and an external additive to the surface of the charging member. However, it has been recognized that suppression of electrostatic adhesion of a toner and an external additive to the surface of the charging member is still susceptible to improvement.

That is, an ion having a polarity opposite to that of the charging voltage adheres to the surface of the charging member and a matter adhering to the surface due to discharge. Therefore, electrostatic adhesive force is increased along with discharge. In particular, under a low-temperature and low-humidity environment, charge of dirt is not cancelled easily due to water in air. Therefore, a toner and an external additive are more liable to adhere to the surface of the charging member.

Figure 1:
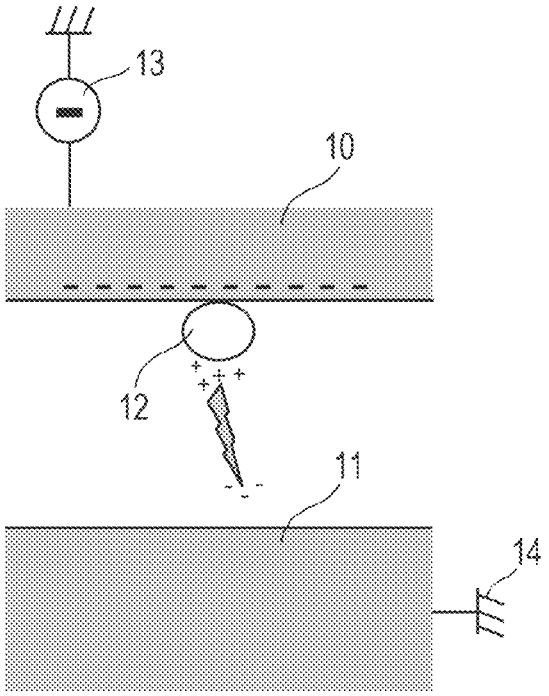
FIG. 1 is an explanatory view of a mechanism of adhesion of dirt to the surface of a charging member.

The case of negative charging is described with reference to FIG. 1. A charging member 10 is connected to a power source 13 and is opposed to a photosensitive drum 11 connected to an earth 14. Discharge occurs in a gap between the charging member 10 and the photosensitive drum 11, and an electron having a negative polarity is attracted to the photosensitive drum 11 and an ion having a positive polarity is attracted to the surface of the charging member 10, along an electric field. In this case, when dirt 12, such as a toner, exists on the surface of the charging member 10, the ion having a positive polarity attracted to the charging member 10 adheres to the dirt 12, and the dirt 12 is charged positively. As a result, electrostatic attraction force between the dirt 12 and the charging member 10 that is charged negatively is increased, and the dirt 12 strongly adheres to the surface of the charging member 10. Further, this phenomenon occurs repeatedly along with the progress of use, and hence the adhesive force of the dirt 12 is increased.

Incidentally, discharge from the charging member to the electrically chargeable body occurs in accordance with the Paschen's Law. Further, a discharge phenomenon can be described as a diffusion phenomenon of electron avalanche in which ionized electrons are increased exponentially by repeating a process of colliding with molecules in air and electrodes to generate electrons and positive ions. The electron avalanche is diffused along an electric field, and the degree of this diffusion determines a final discharged charge amount.

Further, abnormal discharge occurs in the case where a voltage that is excessive according to the Paschen's Law is applied and the electron avalanche diffuses significantly to produce a very large discharged charge amount. In actuality, abnormal discharge can be observed with a high-speed camera and an image intensifier and has a size of from about 200 μm to about 700 μm. The discharge current amount thereof is measured to be about 100 times or more the discharge current amount of normal discharge. Thus, in order to suppress abnormal discharge, it is sufficient that the discharged charge amount generated by the diffusion of the electron avalanche be controlled within a normal range under the condition of a large applied voltage.

Then, the inventors of the present invention have made extensive investigations in order to obtain a charging member which is not liable to cause abnormal discharge even in the case where a charging voltage is increased and which is capable of effectively suppressing electrostatic adhesion of dirt, such as a toner, to the surface of the charging member.

As a result, the inventors have found that the following electroconductive member satisfies the above-mentioned requirements well: an electroconductive member including:

an electroconductive support; and a surface layer on the electroconductive support, in which the surface layer includes a skeleton that is three-dimensionally continuous and a pore that communicates in a thickness direction, in which, when any region measuring 150 μm per side of a surface of the surface layer is photographed and equally divided into 60 parts in a vertical direction and 60 parts in a horizontal direction to form 3,600 squares, the number of squares including through holes is 100 or less, in which the skeleton is non-electroconductive, and in which the skeleton includes a plurality of particles connected to each other through a neck, and an average value D1 of circle-equivalent diameters of the particles is 0.1 μm or more and 20 μm or less.

The charging member according to the present invention is described below with reference to the drawings. Note that, the present invention is not limited to the following embodiment.

(Discharge)

(Abnormal Discharge)

The inventors of the present invention have assumed the reason that, with the charging member having the above-mentioned configuration, the occurrence of abnormal discharge is suppressed, and the electrostatic adhesion of dirt, such as a toner, to the surface of the charging member can be further suppressed, as follows.

(Suppression of Abnormal Discharge)

As described above, abnormal discharge has a size of from about 200 μm to about 700 μm. This size is the result of the growth of normal discharge along an electric field in a space. That is, in order to suppress abnormal discharge, it is sufficient that the growth of normal discharge be suppressed. Normal discharge can be confirmed with a high-speed camera and an image intensifier in the same manner as in abnormal discharge, and its size is 30 μm or less.

The surface layer according to the present invention has a skeleton that is three-dimensionally continuous, and when any region measuring 150 μm per side of a surface of the surface layer is photographed and equally divided into 60 parts in a vertical direction and 60 parts in a horizontal direction to form 3,600 squares, the number of squares including through holes is 100 or less. It is considered that, with this configuration, the diffusion of electron avalanche is limited spatially, and normal discharge can be prevented from growing to a size of abnormal discharge. That is, the surface layer has a pore that communicates in a thickness direction, but has few through holes that penetrate through the surface layer in the same direction as that of an electric field. Therefore, it is considered that discharge from the surface of the electroconductive support is disconnected, and an increase in size of normal discharge is limited.

As a result of directly observing discharge occurring between the electroconductive member for electrophotography according to the present invention and a photosensitive drum through use of a high-speed camera, the following phenomenon can be confirmed. Single-shot discharge is segmentalized in the case where the surface layer that is a porous body exists on the surface of the electroconductive member. From this, it is also considered that the above-mentioned assumed mechanism is correct.

(Suppression of Adhesion of Dirt)

Next, suppression of adhesion of dirt is described. First, dirt adheres to the surface of an electroconductive member due to physical adhesive force or electrostatic attraction force. In particular, dirt caused on a charging member has a distribution of from a positive charge to a negative charge, and hence electrostatic adhesion of dirt cannot be avoided. Further, as described above, in the conventional electroconductive member, an ion having a polarity opposite to that of an applied voltage adheres to the surface of the charging member and a matter adhering to the surface due to discharge. Therefore, electrostatic adhesive force is increased along with discharge, and peeling of dirt that has once adhered to the surface is not likely to be expected.

In the present invention, both physical adhesion and electrostatic adhesion of dirt as described above can be suppressed. First, physical adhesion is described. The surface layer is a porous body having a fine skeleton and pores, and hence a contact point can be significantly reduced to suppress physical adhesion of dirt.

Next, suppression of electrostatic adhesion is described with reference to FIG. 3.

Figure 3:
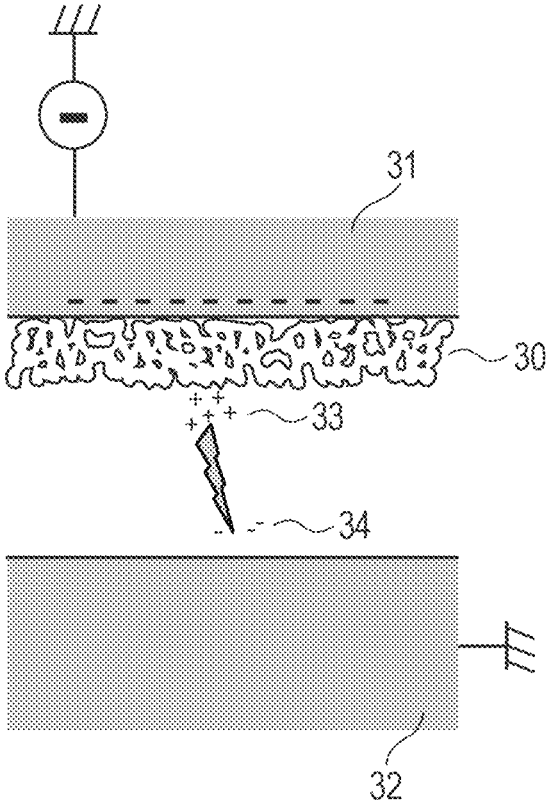
FIG. 3 is a view for illustrating charge-up of a surface layer.

FIG. 3 is a schematic view of a charging member 31 and a photosensitive drum 32 in the case of negative charging. When discharge occurs, a negative charge 34 advances to the surface of the photosensitive drum 32 along an electric field, and a charge 33 having a positive polarity advances to a surface layer 30. In this case, the surface layer 30 is non-electroconductive, and hence the surface layer 30 traps the charge 33 having a positive polarity to be charged up positively. In this case, the surface layer 30 electrostatically repels positively-charged dirt that attempts to adhere to the surface of the charging member 31 due to an electric field, and hence electrostatic attraction force acting on the dirt can be reduced. That is, electrostatic adhesion, which cannot be suppressed in the related art, can be reduced.

Further, even when dirt adheres to the surface of the surface layer 30, a negative discharged charge generated in a large amount on the surface layer 30 adheres to the dirt because the surface layer 30 is a porous body, with the result that the polarity with which the dirt is charged becomes negative. Thus, the polarity is inverted, and the dirt is peeled off due to an electric field.

That is, both physical adhesion and electrostatic adhesion of dirt can be simultaneously suppressed very efficiently, and hence an image defect caused by adhesion of dirt is expected to be reduced.

For the above-mentioned reasons, according to the present invention, both suppression of abnormal discharge and suppression of an image defect caused by adhesion of dirt can be realized. Further, according to the present invention, a process cartridge and an electrophotographic apparatus, which can suppress a void image over a long period of time and suppress an image defect caused by adhesion of dirt can be provided. The present invention is described in detail below.

(Example of Member Configuration)

Figure 2A:
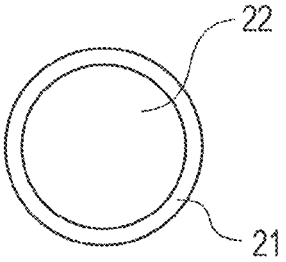
FIG. 2A and FIG. 2B are each a sectional view for illustrating an example of a roller-shaped electroconductive member according to the present invention.
Figure 2B:
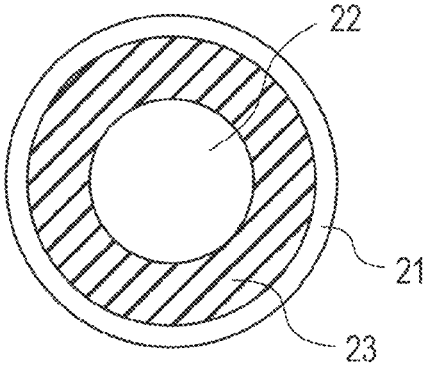

FIG. 2A and FIG. 2B are sectional views of an example of a roller-shaped electroconductive member. The electroconductive member includes an electroconductive support and a surface layer on an outer side of the electroconductive support. The surface layer is formed of a porous body. As examples of a structure of the electroconductive member, there may be given configurations illustrated in FIG. 2A and FIG. 2B.

An electroconductive member of FIG. 2A includes an electroconductive support formed of a cored bar 22 serving as an electroconductive mandrel and a surface layer 21 formed on an outer periphery of the electroconductive support. Further, an electroconductive member of FIG. 2B includes an electroconductive support, which includes the cored bar 22 serving as an electroconductive mandrel and an electroconductive resin layer 23 formed on an outer periphery of the cored bar 22, and the surface layer 21 formed on an outer periphery of the electroconductive support. Note that, the electroconductive member may have a multi-layered configuration in which a plurality of the electroconductive resin layers 23 are arranged as needed as long as the effects of the present invention are not impaired. Further, the electroconductive member is not limited to the roller shape and may have, for example, a blade shape.

<Electroconductive Support>

The electroconductive support may be formed of, for example, the cored bar 22 serving as an electroconductive mandrel as illustrated in FIG. 2A. Further, as illustrated in FIG. 2B, the electroconductive support may be configured to have the cored bar 22 serving as an electroconductive mandrel and the electroconductive resin layer 23 formed on the outer periphery of the cored bar 22. Further, the electroconductive support may have a multi-layered configuration in which a plurality of the electroconductive resin layers 23 are arranged as needed as long as the effects of the present invention are not impaired.

Of those, the configuration of FIG. 2A, in which resistance unevenness caused by a conductive agent in the electroconductive resin layer can be suppressed, is preferred.

[Electroconductive Mandrel]

As a material for forming the electroconductive mandrel, one appropriately selected from materials known in the field of an electroconductive member for electrophotography can be used. For example, there is given a cylindrical material in which a surface of a carbon steel alloy is plated with nickel having a thickness of about 5 μm and the like.

[Electroconductive Resin Layer]

A rubber material, a resin material, or the like can be used as a material for forming the electroconductive resin layer 23.

The rubber material is not particularly limited, and a rubber known in the field of an electroconductive member for electrophotography can be used. Specific examples thereof include an epichlorohydrin homopolymer, an epichlorohydrin-ethylene oxide copolymer, an epichlorohydrin-ethylene oxide-allyl glycidyl ether terpolymer, an acrylonitrile-butadiene copolymer (NBR), a hydrogenated product of an acrylonitrile-butadiene copolymer, a silicone rubber, an acrylic rubber, and a urethane rubber. One kind of those materials may be used alone, or two or more kinds thereof may be used in combination.

A resin known in the field of an electroconductive member for electrophotography can be used as the resin material. Specific examples thereof include an acrylic resin, a polyurethane resin, a polyamide resin, a polyester resin, a polyolefin resin, an epoxy resin, and a silicone resin. One kind of those materials may be used alone, or two or more kinds thereof may be used in combination.

The following materials may be blended in the rubber material or resin material for forming the electroconductive resin layer 23 in order to adjust its electrical resistance value as required: carbon black, graphite, oxides such as tin oxide, and metals such as copper and silver, which exhibit electron conductivity; electroconductive particles to each of which electroconductivity is imparted by covering its particle surface with an oxide or a metal; and ion conductive agents each having ion exchange performance such as a quaternary ammonium salt and a sulfonic acid salt, which exhibit ion conductivity.

In addition, a filler, softening agent, processing aid, tackifier, antitack agent, dispersant, foaming agent, roughening particle, or the like that has been generally used as a blending agent for a rubber or a resin can be added to the extent that the effects of the present invention are not impaired. One kind of those agents may be used alone, or two more kinds thereof may be used in combination.

As a material for forming the electroconductive resin layer 23, it is preferred to use an electron-conductive resin using a conductive agent such as carbon black capable of reducing a phenomenon in which charge-up of the surface layer is released to the electroconductive support. In the case where the conductive agent such as carbon black is used, when a volume resistivity is excessively low, a phenomenon in which charge-up is released to the electroconductive support occurs to reduce the effects of the present invention. Thus, it is preferred that the number of parts of the conductive agent to be added to the electroconductive support be minimized within a range not limiting the effects of the present invention. Further, when the electroconductive support having ion conductivity is used, electroconductive points of the surface of the electroconductive support exist uniformly over the entire surface, and hence a phenomenon in which charge-up of the surface layer is released becomes conspicuous, with the result that the effect of suppressing adhesion of dirt may be reduced.

<Surface Layer>

The surface layer has a skeleton that is three-dimensionally continuous and a pore that communicates in a thickness direction. When any region measuring 150 μm per side of a surface of the surface layer is photographed and equally divided into 60 parts in a vertical direction and 60 parts in a horizontal direction to form 3,600 squares, the number of squares including through holes is 100 or less. The skeleton is non-electroconductive and includes a plurality of particles connected to each other through a neck. An average value D1 of circle-equivalent diameters of the particles is 0.1 μm or more and 20 μm or less.

[(1) Skeleton that is Three-Dimensionally Continuous and Pore that Communicates]

The surface layer has a skeleton that is three-dimensionally continuous. The skeleton that is three-dimensionally continuous as used herein refers to a skeleton having a plurality of branches and a plurality of portions connected from the outermost surface of the electroconductive member to the surface of the electroconductive support.

Further, the surface layer has a pore that communicates in a thickness direction so as to transport discharge occurring in the skeleton to the surface of the drum. The pore that communicates in a thickness direction as used herein refers to a pore extending from an opening of the surface of the surface layer to the surface of the electroconductive support.

Further, it is preferred that the pore be configured to connect a plurality of openings of the surface of the surface layer and have a plurality of branches. When the pore connects a plurality of openings and has a plurality of branches as just described, electron avalanche can be disconnected more reliably in the surface layer.

Further, the pore that communicates ensures a path of discharge from the surface of the electroconductive support to the surface of the surface layer, and hence a discharged charge in an amount suitable for forming an image can be obtained even in the non-electroconductive surface layer.

Further, the contact area of dirt is reduced to suppress adhesion of dirt. Further, even when dirt adheres to the surface, a discharged charge having passed through the pore adheres to the adhering dirt to invert the charge of the dirt, to thereby cause the dirt to be peeled off electrostatically.

It can be confirmed in an SEM image acquired by a scanning electron microscope (SEM) or a three-dimensional image of a porous body acquired by a three-dimensional transmission electron microscope, an X-ray CT inspection device, or the like that the skeleton of the surface layer is three-dimensionally continuous and the pore communicates in a thickness direction. That is, in the SEM image or the three-dimensional image, it is only necessary that the skeleton have a plurality of branches and a plurality of portions connected from the surface of the surface layer to the surface of the electroconductive support. Further, it is only necessary to confirm that the pore connects a plurality of openings of the surface of the surface layer, and has a plurality of branches and extends from the surface of the surface layer to the surface of the electroconductive support.

[(2) Degree of Existence of Through Hole]

When any region measuring 150 μm per side of a surface of the surface layer is photographed and equally divided into 60 parts in a vertical direction and 60 parts in a horizontal direction to form 3,600 squares, the number of squares including through holes is preferably 100 or less, more preferably 25 or less. The through hole as used herein refers to a pore through which the surface of the electroconductive support can be directly observed at a position facing the surface of the surface layer.

In a charging device, a bias is applied between an electroconductive support of a charging member and an electroconductive support of an electrically chargeable body. Therefore, when a large number of linear holes, that is, through holes exist on the surface layer in a direction of an electric field, discharge from the surface of the electroconductive support is liable to grow into abnormal discharge. The occurrence of abnormal discharge can be suppressed by limiting the number of pores extending in the same direction as that of the electric field, that is, through holes as described above.

Note that, there is no particular limitation on the lower limit of the number of squares including through holes, but the number is preferably small. Specifically, the number is most preferably 0 from the viewpoint of suppressing the occurrence of abnormal discharge.

The presence/absence of through holes in the surface layer can be confirmed as follows. First, the surface layer is observed from a direction facing the surface layer, and any region measuring 150 μm per side of the surface of the surface layer is photographed. In this case, a method capable of observing the region measuring 150 μm per side, such as a laser microscope, an optical microscope, or an electron microscope, may be used suitably.

Figure 5:
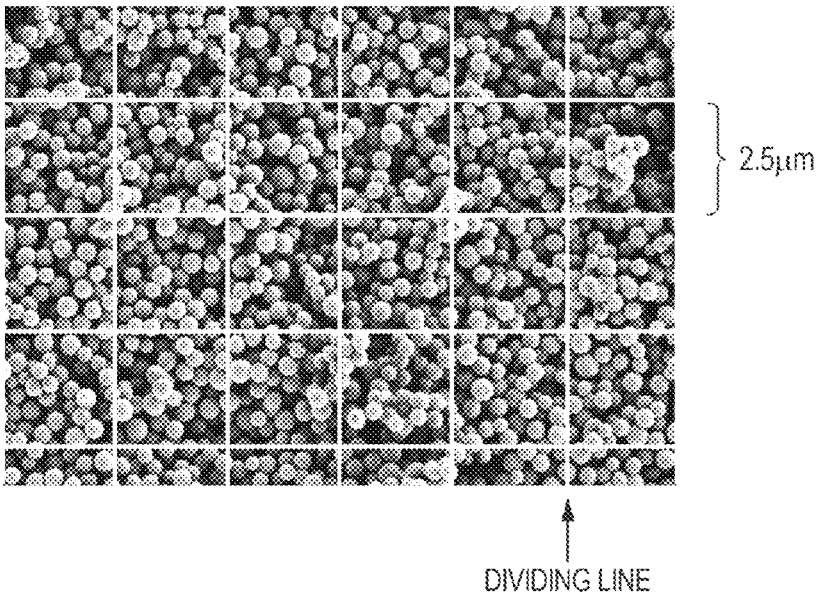
FIG. 5 is an explanatory diagram of a method of evaluating a pore.

Then, as in an illustration of a part of the region in FIG. 5, when the region is divided into 60 parts in a vertical direction and 60 parts in a horizontal direction, the number of squares including through holes may be counted.

[(3) Non-Electroconductivity]

The skeleton of the surface layer is non-electroconductive. Non-electroconductivity means that a volume resistivity is $1\times10^{10}$ Ω·cm or more. When the surface layer is non-electroconductive, the skeleton of the surface layer can trap an ion having a polarity opposite to that of a charging voltage due to discharge to be charged up. This charge-up can reduce electrostatic adhesion of dirt, and further invert the charge of adhering dirt to cause the dirt to be peeled off.

It is preferred that the skeleton of the surface layer have a volume resistivity of $1\times10^{10}$ Ω·cm or more and $1\times10^{17}$ Ω·cm or less. When the volume resistivity is set to $1\times10^{10}$ Ω·cm or more, the skeleton starts being charged up, thereby being capable of suppressing adhesion of dirt. Meanwhile, when the volume resistivity is set to $1\times10^{10}$ Ω·cm or less, the occurrence of discharge in the pore of the surface layer is accelerated, and dirt can be electrostatically peeled off. Further, it is more preferred that the volume resistivity be set to $1\times10^{15}$ Ω·cm or more and $1\times10^{17}$ Ω·cm or less because the influence of variation in charge-up in the surface layer can be reduced, and the electrostatic peeling of dirt can be further accelerated.

Note that, the volume resistivity of the surface layer is measured by the following measurement method. First, a test piece not including the pore of the skeleton is taken off from the surface layer located on the surface of the electroconductive member with tweezers. Then, a cantilever of a scanning probe microscope (SPM) is brought into contact with the test piece, and the test piece is pinched between the cantilever and an electroconductive substrate so as to measure a volume resistivity. The electroconductive member is equally divided into 10 regions in a longitudinal direction. Any one point in each of the obtained 10 regions (10 points in total) is measured for the volume resistivity, and an average value of the measured volume resistivities is defined as the volume resistivity of the surface layer.

[(4) Neck]

The skeleton of the surface layer includes a plurality of particles connected to each other through a neck.

The neck as used herein refers to a portion between particles, which is constricted into a one-sheet hyperbolic shape (drum shape) that is formed by the movement of a constituent material of the particles and that has a smooth curved surface without non-continuous points.

FIG. 4A to FIG. 4D are each a schematic view for two-dimensionally illustrating, as an example of the skeleton of the surface layer, a part of a skeleton of a surface layer produced through use of spherical particles. In FIG. 4A to FIG. 4D, particles 41 are connected to each other through a neck 42. The neck 42 is illustrated as a straight line in FIG. 4A to FIG. 4D, but the neck 42 actually refers to a cross-section taken along the broken line of FIG. 4A to FIG. 4D.

Figure 4A:
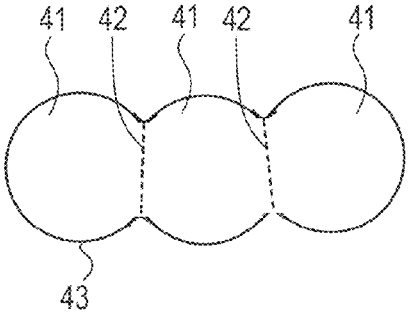
FIG. 4A, FIG. 4B, FIG. 4C and FIG. 4D are each an explanatory view of a neck.
Figure 4B:
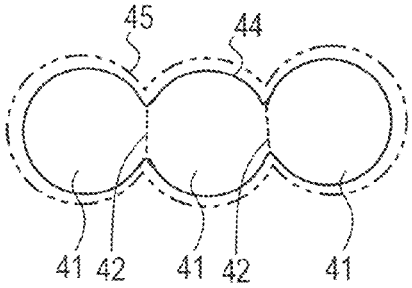
Figure 4C:
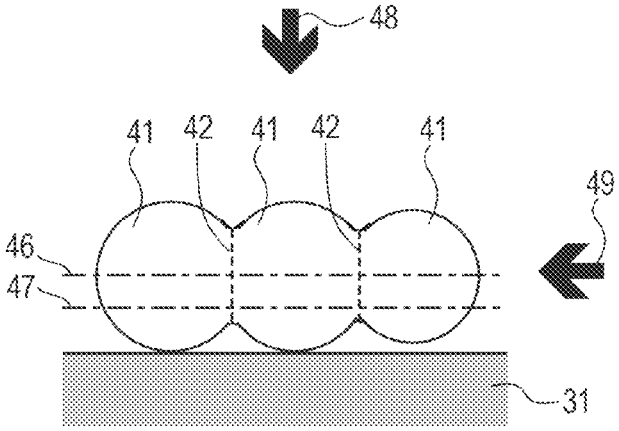
Figure 4D:
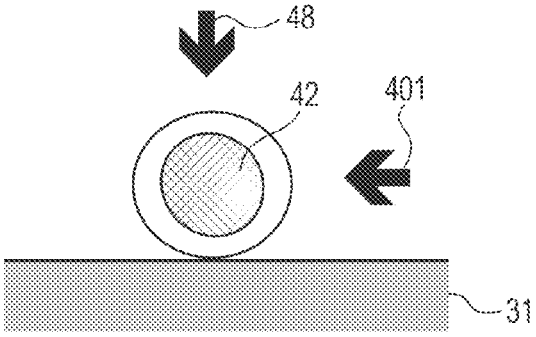

FIG. 4A to FIG. 4C are illustrations of cut surfaces of a plurality of connected particles, and FIG. 4D is an illustration of a cut surface of a neck portion.

FIG. 4A and FIG. 4B are illustrations of cut surfaces parallel to the surface of the electroconductive support, and FIG. 4C and FIG. 4D are illustrations of cut surfaces perpendicular to the surface of the electroconductive support.

FIG. 4A and FIG. 4B are sectional views when seen from the direction of the arrow 48 of FIG. 4C and FIG. 4D. FIG. 4C is a sectional view when seen from the direction of the arrow 401 of FIG. 4D. FIG. 4D is a sectional view when seen from the direction of the arrow 49 of FIG. 4C.

A cut surface 43 indicated by the solid line in FIG. 4A is a cut surface obtained by cutting along a surface 46 illustrated in FIG. 4C. A cut surface 44 indicated by the solid line in FIG. 4B is a cut surface obtained by cutting along a surface 47 illustrated in FIG. 4C, and a double-dotted broken line 45 of FIG. 4B corresponds to the cut surface 43 indicated by the solid line in FIG. 4A. As illustrated in FIG. 4A to FIG. 4C, the area of the cut surface changes and the length of the neck 42 appearing on the cut surface also changes depending on the height of a surface for cutting the skeleton of the surface layer from the surface of the electroconductive support.

When a plurality of particles are three-dimensionally connected to each other through necks, a wall of a pore has irregularities. Therefore, the shape of the pore becomes more complicated, and the effect of suppressing diffusion of electron avalanche is further enhanced. As a result, the effect of suppressing the occurrence of abnormal discharge can be further enhanced.

Further, when the particles are connected to each other through necks, an electrical interface between the particles is eliminated. Therefore, the skeleton forming the surface layer can be considered as one dielectric body. When the skeleton serves as one dielectric body, the variation in charge-up can be suppressed, and uniform discharge can be formed in the entire surface layer.

Further, when the plurality of particles are connected to each other through the necks, the structure of the surface layer is less liable to change, and the above-mentioned effects can be kept during the operating life of the electrophotographic apparatus.

Further, due to the presence of the neck, the irregularities are increased in the shape of the pore, and the pore has a more complicated structure. The irregularities of the pore also provide irregularities to an electric field distribution, and it is considered that such non-uniform portion of the electric field distribution has a feature of causing discharge easily. That is, the complicated shape of the pore formed by the neck increases the probability of the occurrence of discharge in the pore to increase the amount of charge-up. As a result, the effects of reducing adhesion of dirt and accelerating peeling of dirt can be obtained.

Note that, for confirmation of the connection of the particles through the necks, it is only necessary to observe a connected portion of the particles based on a three-dimensional image acquired by X-ray CT measurement or with a laser microscope, an optical microscope, an electron microscope, or the like. In this case, it is only necessary to photograph the skeleton and the neck and to confirm that the connected portion of the particles is constricted into a one-sheet hyperbolic shape (drum shape) having a smooth curved surface without non-continuous points.

Figure 6:
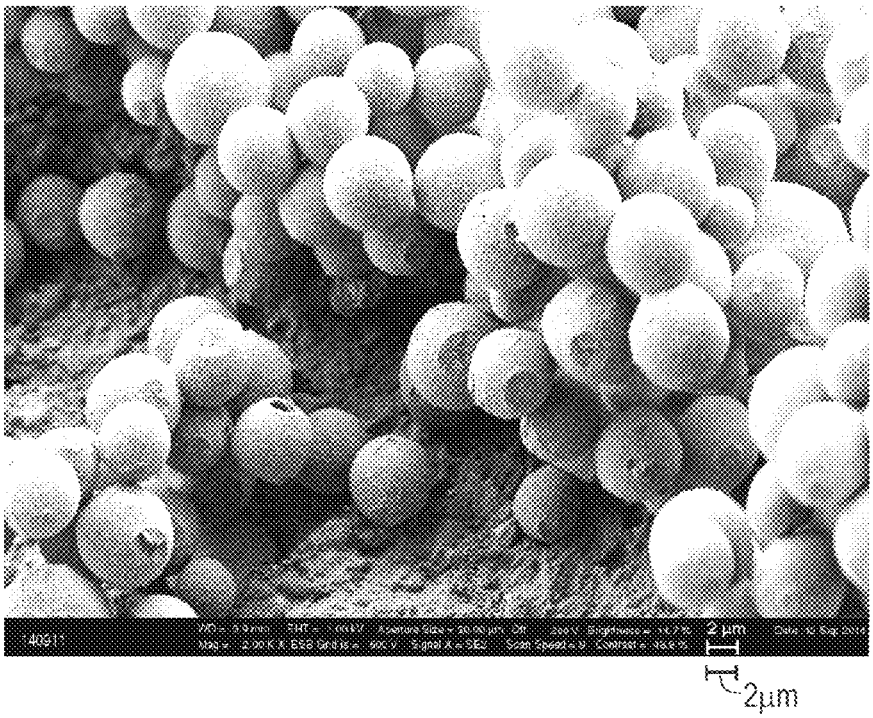
FIG. 6 is an example of a confirmation image of the neck.

Further, as another method of confirming a neck, there is given a method involving crushing the surface layer with tweezers to decompose the connected particles. When the decomposed and separated particles are further observed, traces of the connection can be confirmed as shown in FIG. 6, and thus it can be confirmed that the particles were connected to each other through the necks.

[Shape of Particle]

Particles forming the skeleton of the surface layer may have any shape as long as the skeleton that is three-dimensionally continuous and the pore that communicates in a thickness direction can be formed. The shape may be a circle, an oval, a polygon, such as a rectangle, a semicircle, or any shape. Of those, the particles are preferably spherical particles because structural control of thickness, porosity, and the like can be suitably realized, and satisfactory image quality is obtained.

For confirmation of the shape of the particles, it is only necessary to observe a connected portion of the particles based on a three-dimensional image acquired by X-ray CT measurement or with a laser microscope, an optical microscope, an electron microscope, or the like. In this case, it is only necessary to photograph the skeleton and the neck and to visually confirm the shape of the particles cut by the neck in image processing, to thereby define the result as the shape of the particles.

Further, as another method of confirming the shape of the particles, there is given a method involving crushing the surface layer with tweezers to decompose the connected particles. When the decomposed and separated particles are further observed, the shape of the particles can be confirmed.

[Average Value D1 of Circle-Equivalent Diameter of Particle]

It is preferred that the average value D1 of circle-equivalent diameters of the particles forming the skeleton of the surface layer be 0.1 μm or more. When the average value D1 is 0.1 μm or more, the pore is appropriately formed, and discharge in the surface layer can be accelerated to cause dirt to be peeled off. Further, the average value D1 is preferably 20 μm or less, particularly preferably 3.5 μm or less. When the average value D1 is set to 20 μm or less, an image defect derived from the non-electroconductive structure can be suppressed. Further, when the average value D1 is set to 3.5 μm or less, the effect of suppressing diffusion of discharge in the pore is enhanced, and the occurrence of abnormal discharge can be further suppressed. Further, when the average value D1 is set to 3.5 μm or less, dirt to be embedded in the pore of the surface of the surface layer is reduced, and an image defect derived from adhesion of dirt can be suppressed.

Note that, for calculation of the average value D1 of the circle-equivalent diameters of the particles, it is only necessary to observe a connected portion of the particles based on a three-dimensional image acquired by X-ray CT measurement or with a laser microscope, an optical microscope, an electron microscope, or the like. In particular, the X-ray CT measurement is preferred because the surface layer can be measured three-dimensionally. For example, a slice image of a skeleton and a neck is taken through use of an X-ray CT inspection device (trade name: TOHKEN-Sky-Scan2011 (radiation source: TX-300), manufactured by Mars Tohken X-ray inspection Co., Ltd.). Measurement may be performed based on the acquired slice image by image processing software, such as Image-pro plus (product name, manufactured by Media Cybernetics Corporation).

Specifically, a slice image acquired from two particles connected to each other through a neck is used. A cut surface is found, which is a cross-section perpendicular to the cross-section of the neck as illustrated in FIG. 4A and FIG. 4B and which is such a cut surface that, of a plurality of cut surfaces parallel to the surface of the electroconductive support, the length of the neck included in the cut surface is largest. The found cut surface is binarized by an Ohtsu method. Next, for example, watershed processing is performed to create a neck connecting portions of a contour, which are most recessed. Then, a center of gravity of a particle cut by the neck is calculated, and with the center of gravity being the center, a radius of a circumcircle in contact with a boundary of the particle may be measured as a circle-equivalent diameter of the particle. The electroconductive member is equally divided into 10 regions in a longitudinal direction. Any 50 particles in any image in each region of the obtained 10 regions (500 particles in total) are measured for the circle-equivalent diameters of the particles, and an arithmetic average value (hereinafter sometimes referred to as "average value") thereof is defined as the average value D1 of the circle-equivalent diameters of the particles.

Further, as another method of confirming the shape of the particles, there is given a method involving crushing the surface layer with tweezers to decompose the connected particles. An image of the decomposed and separated particles is acquired on the surface of the electroconductive support with a laser microscope, an optical microscope, an electron microscope, or the like, and the average value D1 of the circle-equivalent diameters may be measured by the same method as above.

[Ratio Between Circle-Equivalent Diameter of Cross-Section of Neck and Circle-Equivalent Diameter of Particle]

An average value D2 of circle-equivalent diameters of cross-sections of a neck for forming the skeleton of the surface layer is preferably 0.1 time or more and 0.7 time or less of the average value D1 of the circle-equivalent diameters of the particles. When the average value D2 is set to 0.1 time or more, a discharge space is disconnected to obtain the effect of suppressing abnormal discharge. When the average value D2 is set to 0.7 time or less, an electric field in the pore has a complicated distribution, and the probability of the occurrence of discharge in the pore is increased to increase a discharged charge in the pore, with the result that the effect of peeling of dirt and enhancement of image quality can be obtained.

[Average Value D2 of Circle-Equivalent Diameter of Cross-Section of Neck]

Note that, for measurement of a circle-equivalent diameter of a cross-section of a neck, it is only necessary to observe a connected portion of particles based on a three-dimensional image acquired by X-ray CT measurement or with a laser microscope, an optical microscope, an electron microscope, or the like. In particular, the X-ray CT measurement is preferred because the surface layer can be measured three-dimensionally.

Specifically, a slice image acquired from two particles connected to each other through a neck by the X-ray CT measurement is used, and a sectional image of the neck 42 as illustrated in FIG. 4D is created and binarized by an Ohtsu method. Then, a center of gravity of the cross-section of the neck is calculated, and with the center of gravity being the center, a radius of a circumcircle in contact with a boundary of the cross-section of the neck may be measured as a circle-equivalent diameter of the cross-section of the neck. The electroconductive member is equally divided into 10 regions in a longitudinal direction. Any 20 particles in any image in each region of the obtained 10 regions (200 particles in total) are measured for a circle-equivalent diameter of the cross-section of the neck, and the average value D2 is calculated.

Further, as another method of measuring a circle-equivalent diameter of a cross-section of a neck, there is given a method involving crushing the surface layer with tweezers to decompose the connected particles. An image of the decomposed and separated particles is acquired on the surface of the electroconductive support, and circle-equivalent diameters of the particles and a circle-equivalent diameter of a portion that was a connected portion corresponding to the cross-section of the neck may be measured.

[Thickness]

It is only necessary that the thickness of the surface layer fall within a range not impairing the effects of the present invention, and specifically, the thickness is preferably 1 μm or more and 50 μm or less. When the thickness of the surface layer is 1 μm or more, the skeleton starts being charged up to express the effect of suppressing abnormal discharge. Further, when the thickness of the surface layer is 50 μm or less, discharge in the pore reaches the photosensitive drum, and an image can be formed without the occurrence of shortage of charging. The thickness is more preferably 8 μm or more and 20 μm or less. When the thickness is 8 μm or more, the diffusion of discharge is accelerated, and abnormal discharge can be further suppressed. When the thickness is 20 μm or less, the polarity of dirt adhering to the surface layer is inverted suitably, and an image defect derived from adhesion of dirt can be further suppressed.

Further, it is understood that the above-mentioned effects are also influenced by the ratio between the average of the circle-equivalent diameters of the particles and the thickness. When a plurality of layers of particles are laminated, the shape of the pore becomes complicated, and the effects of the present invention can be exhibited more reliably. Therefore, the ratio of the thickness to the average value D1 of the circle-equivalent diameters of the particles is preferably 1.5 or more and 10 or less.

Note that, the thickness of the surface layer is confirmed as follows. A segment including the electroconductive support and the surface layer is cut from the electroconductive member, and the segment is subjected to X-ray CT measurement so as to measure the thickness of the surface layer. Specifically, a two-dimensional slice image acquired by the X-ray CT measurement was binarized by an Ohtsu method to identify a skeleton portion and a pore portion. In each binarized slice image, the ratio of the skeleton portion was converted into numerical values, and the numerical values were confirmed from the electroconductive support side to the surface layer side.

Then, the outermost surface of the surface layer on a side closest to the electroconductive substrate was defined as a surface that provided a slice surface in which the ratio of the skeleton portion reached 2% or more for the first time when slicing was performed successively from a lower portion (electroconductive substrate side) of the surface layer in a direction of being separated from the electroconductive substrate through use of X-ray CT. Note that, the outermost surface of the surface layer on a side closest to the electroconductive substrate is sometimes referred to as "lowermost portion of the surface layer."

For example:

the ratio of the skeleton portion in an (n−1)-th slice image acquired at a height h1 from the electroconductive support is less than 2%;

the ratio of the skeleton portion in an n-th slice image acquired at a height h2 from the electroconductive support is also less than 2%; and the ratio of the skeleton portion in an (n+1)-th slice image acquired at a height h3 from the electroconductive support is 2% or more.

A relationship: height h1<height h2<height h3 is satisfied, and n represents any natural number.

As described above, the height h3 at which the (n+1)-th slice image is acquired when the ratio of the skeleton portion changes from less than 2% to 2% or more corresponds to the height of the lowermost portion of the surface layer.

Similarly, the outermost surface of the surface layer on a side farthest from the electroconductive substrate was defined as a surface that provided a slice surface in which the ratio of the skeleton portion reached 2% or more for the first time when slicing was performed successively from the upper portion of the surface layer toward the electroconductive substrate through use of X-ray CT. Note that, the outermost surface of the surface layer on a side farthest from the electroconductive substrate is sometimes referred to as "outermost surface portion of the surface layer."

For example:

the ratio of the skeleton portion in an (N−1)-th slice image acquired at a height H1 from the electroconductive support is 2% or more;

the ratio of the skeleton portion in an N-th slice image acquired at a height H2 from the electroconductive support is 2% or more; and the ratio of the skeleton portion in an (N+1)-th slice image acquired at a height H3 from the electroconductive support is less than 2%.

A relationship: height H1<height H2<height H3 is satisfied, and N represents any natural number.

As described above, the height H2 at which the N-th slice image is acquired when the ratio of the skeleton portion changes from 2% or more to less than 2% corresponds to the height of the outermost surface portion of the surface layer.

Then, a difference between the height of the lowermost portion of the surface layer and the height of the outermost surface portion of the surface layer was defined as the thickness of the surface layer.

The "ratio of the skeleton portion" as used herein refers to {(area of skeleton portion)/(area of skeleton portion+area of pore portion)}. The electroconductive member is equally divided into 10 regions in a longitudinal direction. Any one point in each of the obtained 10 regions (10 points in total) is measured for the thickness of the surface layer, and an average value thereof is defined as the thickness of the surface layer.

[Porosity]

Any porosity may be adopted as the porosity of the surface layer as long as the effects of the present invention are not impaired. Specifically, it is preferred that the porosity of the surface layer be 20% or more and 80% or less. When the porosity is 20% or more, discharge is allowed to occur in the pore in an amount sufficient for forming an image. Further, when the porosity is 80% or less, the effect of reducing the diffusion of discharge is expressed so that abnormal discharge can be suppressed. The porosity is more preferably 50% or more and 75% or less.

The porosity of the surface layer is confirmed as follows. A segment including the electroconductive support and the surface layer is cut from the electroconductive member, and the segment is subjected to X-ray CT measurement so as to measure the porosity of the surface layer. Specifically, a two-dimensional slice image acquired by the X-ray CT measurement was binarized by an Ohtsu method to identify a skeleton portion and a pore portion. In each binarized slice image, an area of the skeleton portion and an area of the pore portion were converted into numerical values, and the numerical values were confirmed from the electroconductive support side to the surface layer side. The region in which the ratio of the skeleton portion reached 2% or more was defined as the surface layer, and the outermost surface portion and the lowermost portion were defined as described above.

Then, volumes of the skeleton portion and the pore portion were respectively calculated, and the volume of the pore portion was divided by their total volume to obtain porosity. The electroconductive member is equally divided into 10 regions in a longitudinal direction. Any one point in each of the obtained 10 regions (10 points in total) is measured for the porosity of the surface layer, and an average value of the measured porosities is defined as the porosity of the surface layer.

[Material]

There is no particular limitation on the material for the skeleton forming the surface layer as long as the skeleton can be formed. A polymer material such as a resin, an inorganic material such as silica or titania, a hybrid material of the polymer material and the inorganic material, or the like may be used. In this case, the polymer material refers to a material having a large molecular weight, and examples thereof include a polymer obtained by polymerizing a monomer, such as a semisynthetic polymer and a synthetic polymer, and a compound having a large molecular weight such as a natural polymer.

Examples of the polymer material include: a (meth) acrylic polymer such as polymethyl methacrylate (PMMA); a polyolefin-based polymer such as polyethylene or polypropylene; polystyrene; polyimide, polyamide, and polyamide imide; a polyarylene (aromatic polymer) such as poly-p-phenylene oxide or poly-p-phenylene sulfide; polyether; polyvinyl ether; polyvinyl alcohol (PVOH); a polyolefin-based polymer, polystyrene, polyimide, or polyarylene (aromatic polymer) into which a sulfonic group (—$SO_3H$), a carboxyl group (—COOH), a phosphoric group, a sulfonium group, an ammonium group, or a pyridinium group is introduced; a fluorine-containing polymer such as polytetrafluoroethylene or polyvinylidene fluoride; a perfluorosulfonic acid polymer, perfluorocarboxylic acid polymer, and perfluorophosphoric acid polymer in which a sulfonic group, a carboxyl group, a phosphoric group, a sulfonium group, an ammonium group, or a pyridinium group is introduced into a skeleton of the fluorine-containing polymer; a polybutadiene-based compound; a polyurethane-based compound such as an elastomer or a gel; an epoxy-based compound; a silicone-based compound; polyvinyl chloride; polyethylene terephthalate; (acetyl)cellulose; nylon; and polyarylate. Note that, one of those polymers may be used alone, or a plurality thereof may be used in combination. In addition, the polymer may have a particular functional group introduced into its polymer chain. In addition, the polymer may be a copolymer produced from a combination of two or more kinds of monomers to be used as raw materials of those polymers.

Examples of the inorganic material include oxides of Si, Mg, Al, Ti, Zr, V, Cr, Mn, Fe, Co, Ni, Cu, Sn, and Zn, More specific examples thereof may include metal oxides such as silica, titanium oxide, aluminum oxide, alumina sol, zirconium oxide, iron oxide, and chromium oxide. One kind of those inorganic materials may be used alone, or two or more kinds thereof may be used in combination.

Of the materials given above, an organic material capable of being suitably charged up is preferably used. Of those, an acrylic polymer as typified by PMMA having a high insulation property is more preferably used.

[Additive]

In order to adjust the electric resistivity, an additive may be added to the material for the skeleton of the surface layer as long as the effects of the present invention are not impaired and the surface layer can be formed. Examples of the additive include: carbon black, graphite, oxides such as tin oxide, and metals such as copper and silver, which exhibit electron conductivity; electroconductive particles to each of which electroconductivity is imparted by covering its particle surface with an oxide or a metal; and ion conductive agents each having ion exchange performance such as a quaternary ammonium salt and a sulfonic acid salt, which exhibit ion conductivity. One kind of those additives may be used alone, or two or more kinds thereof may be used in combination. In addition, a filler, softening agent, processing aid, tackifier, antitack agent, dispersant, or the like that has been generally used as a blending agent for a resin may be added as long as the effects of the present invention are not impaired.

[Method of Forming Surface Layer and Control of Neck Diameter]

There is no particular limitation on a method of forming the surface layer as long as the surface layer can be formed, and it is only necessary to deposit particles on the electroconductive support and connect the particles to each other through necks in a later step.

As a method of depositing particles on the electroconductive support, there may be given a method involving applying fine particles contained in a brush roller or a sponge roller to the electroconductive support by a roll-to-roll process, an electrostatic powder coating method, a fluidized dip coating method, an electrostatic fluidized dip coating method, a direct coating method such as a spray powder coating method, an electrospray method, and a spray coating method of a fine particle dispersion liquid. Of those, a method involving applying fine particles contained in a brush roller or a sponge roller to the electroconductive support by a roll-to-roll process is preferred because the thickness of the surface layer can be suitably controlled due to the simultaneous removal and application of fine particles, and compression can be realized together with application. The application amount can be suitably controlled by the number of rotations and rotation time of the roll.

As a method of connecting particles to each other through necks, there are given methods of connecting particles by heating, thermal crimping, infrared irradiation, and a binder resin. Of those, methods of connecting particles by subjecting a film of deposited particles obtained through deposition of particles to heating or thermal crimping are preferred because particles in the surface layer can also be suitably fused.

The above-mentioned neck ratio R may be controlled by conditions in the connecting step, for example, heating temperature and heating time.

<Rigid Structure Configured to Protect Surface Layer>

Dirt that attempts to adhere to the surface layer adheres thereto physically or electrostatically. When a rigid structure configured to protect the surface layer is introduced, the surface layer is not brought into contact with the photosensitive drum, and hence a phenomenon in which dirt physically adheres to the surface layer can be substantially avoided.

Further, when the surface layer changes in structure, there is a risk in that discharging characteristics may also change. Thus, particularly in the case where long-term use is intended, it is preferred that the friction and wearing between the surface of the photosensitive drum and the surface layer be reduced so as to suppress a change in structure of the surface layer by introducing a rigid structure configured to protect the surface layer. In this case, the rigid structure refers to a structure that is deformed in an amount of 1 μm or less when abutting against the photosensitive drum. There is no limitation on a method of providing the rigid structure as long as the effects of the present invention are not impaired. For example, there are given a method involving forming a convex portion on the surface of the electroconductive support and a method involving introducing a spacing member into the electroconductive member.

[Convex Portion on Surface of Electroconductive Support]

In the case where the electroconductive support has the configuration as illustrated in FIG. 2A, there is given a method involving processing the surface of the cored bar 22 into a shape having a convex portion. An example thereof is a method involving forming the convex portion on the surface of the cored bar 22 by sandblasting, laser processing, polishing, or the like. Note that, the convex portion may be formed by other methods.

In the case where the electroconductive support has the configuration as illustrated in FIG. 2B, there is given a method involving processing the surface of the electroconductive resin layer 23 into a shape having a convex portion. Examples thereof include a method involving processing the electroconductive resin layer 23 by sandblasting, laser processing, polishing, or the like, and a method involving dispersing a filler such as organic particles or inorganic particles in the electroconductive resin layer 23.

As a material for forming the organic particles, there are given, for example, a nylon resin, a polyethylene resin, a polypropylene resin, a polyester resin, a polystyrene resin, a polyurethane resin, a styrene-acrylic copolymer, a polymethyl methacrylate resin, an epoxy resin, a phenol resin, a melamine resin, a cellulose resin, a polyolefin resin, and a silicone resin. One kind of those materials may be used alone, or two or more kinds thereof may be used in combination.

In addition, as a material for forming the inorganic particles, there are given, for example, silicon oxide such as silica, aluminum oxide, titanium oxide, zinc oxide, calcium carbonate, magnesium carbonate, aluminum silicate, strontium silicate, barium silicate, calcium tungstate, clay mineral, mica, talc, and kaolin. One kind of those materials may be used alone, or two or more kinds thereof may be used in combination. In addition, both of the organic particles and the inorganic particles may be used.

In addition to the above-mentioned method involving processing the electroconductive support, there is given a method involving introducing a convex portion independent from the electroconductive support. An example thereof is a method involving winding a thread-shaped member such as a wire around the electroconductive support.

It is preferred that, in order to obtain the effect of protecting the porous body, the density of the convex portion be set such that at least a part of the rigid structure is observed in a square region measuring 1.0 mm per side in a surface of the surface layer when observed from a direction facing the surface layer. There is no limitation on the size and thickness of the convex portion as long as the effects of the present invention are not impaired. Specifically, it is preferred that the size and thickness of the convex portion fall within a range in which an image defect is not caused by the presence of the convex portion. There is no limitation on the height of the convex portion as long as the height of the convex portion is larger than the thickness of the surface layer and the effects of the present invention are not impaired. Specifically, it is preferred that the height of the convex portion fall within a range in which the height of the convex portion is larger than at least the thickness of the surface layer and a charging defect is not caused by a large discharging gap.

[Spacing Member]

There is no limitation on the spacing member as long as the spacing member can separate the photosensitive drum and the surface layer from each other and the effects of the present invention are not impaired. Examples of the spacing member include a ring and a spacer.

As an example of a method of introducing the spacing member, in the case where the electroconductive member has a roller shape, there is given a method involving introducing a ring having an outer diameter larger than that of the electroconductive member and having a hardness capable of holding a gap between the photosensitive drum and the electroconductive member. Further, as another example of the method of introducing the spacing member, in the case where the electroconductive member has a blade shape, there is given a method involving introducing a spacer capable of separating the porous body and the photosensitive drum from each other so as to prevent friction and wearing between the porous body and the photosensitive drum.

There is no limitation on a material for forming the spacing member as long as the effects of the present invention are not impaired. In addition, it is sufficient that a known non-electroconductive material be used appropriately in order to prevent electric conduction through the spacing member. Examples of the material for the spacing member include: polymer materials excellent in sliding property such as a polyacetal resin, a high-molecular-weight polyethylene resin, and a nylon resin; and metal oxide materials such as titanium oxide and aluminum oxide. One kind of those materials may be used alone, or two or more kinds thereof may be used in combination.

There is no limitation on a position at which the spacing member is introduced as long as the effects of the present invention are not impaired, and for example, it is sufficient that the spacing member be set at ends in a longitudinal direction of the electroconductive support.

Figure 7:
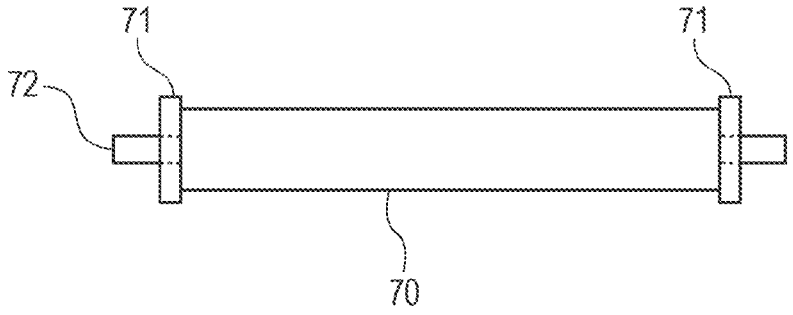
FIG. 7 is a view for illustrating an example of a spacing member.

FIG. 7 is an illustration of an example (roller shape) of the electroconductive member in the case where the spacing member is introduced. In FIG. 7, an electroconductive member is represented by reference numeral 70, a spacing member is represented by reference numeral 71, and an electroconductive mandrel is represented by reference numeral 72.

<Process Cartridge>

Figure 8:
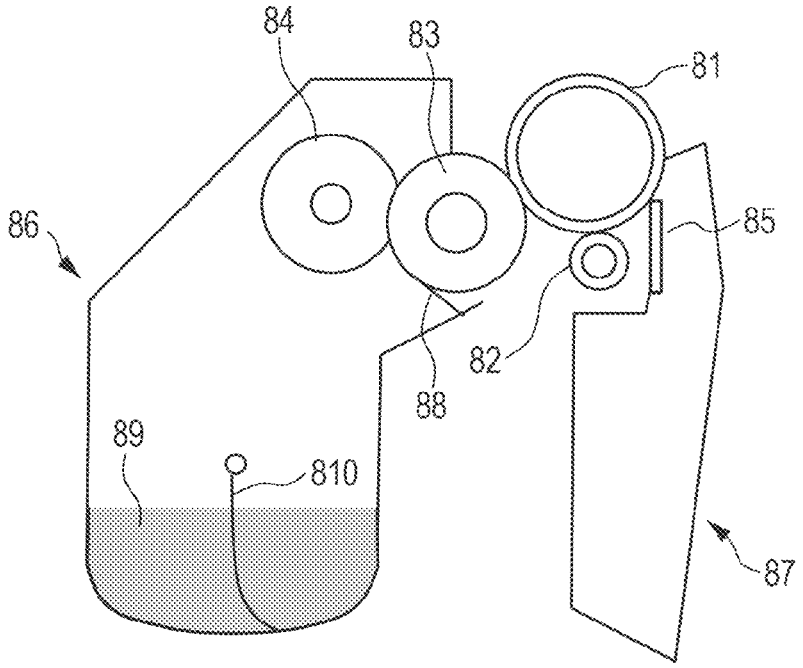
FIG. 8 is an explanatory view of a process cartridge according to the present invention.

FIG. 8 is a schematic sectional view of a process cartridge for electrophotography including the electroconductive member as a charging roller. The process cartridge includes a developing device and a charging device integrally and is configured so as to be removably mounted onto the main body of an electrophotographic apparatus. The developing device includes at least a developing roller 83 and a toner container 86 integrally, and as needed, may include a toner supply roller 84, a toner 89, a developing blade 88, and a stirring blade 810. The charging device includes at least a photosensitive drum 81, a cleaning blade 85, and a charging roller 82 integrally, and may include a waste toner container 87. The charging roller 82, the developing roller 83, the toner supply roller 84, and the developing blade 88 are each configured to be supplied with a voltage.

<Electrophotographic Apparatus>

Figure 9:
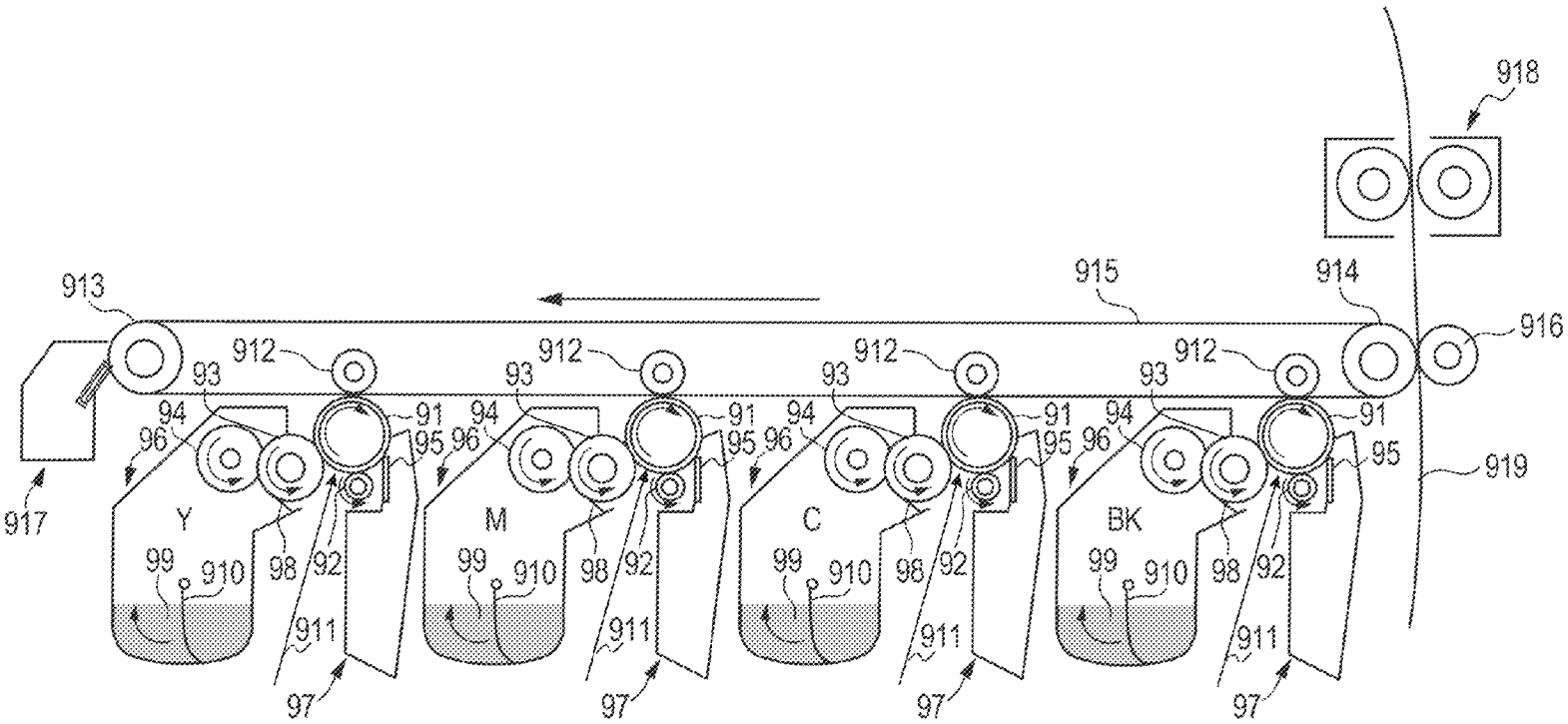
FIG. 9 is an explanatory view of an electrophotographic image forming apparatus according to the present invention.

FIG. 9 is a schematic configuration view of an electrophotographic apparatus using the electroconductive member as a charging roller. The electrophotographic apparatus is a color electrophotographic apparatus having four of the above-mentioned process cartridges removably mounted thereon. The respective process cartridges use toners of respective colors: black, magenta, yellow, and cyan. A photosensitive drum 91 rotates in an arrow direction and is uniformly charged by a charging roller 92 having a voltage from a charging bias power source applied thereto. Then, an electrostatic latent image is formed on a surface of the photosensitive drum 91 with exposure light 911. On the other hand, a toner 99 accommodated in a toner container 96 is supplied to a toner supply roller 94 by a stirring blade 910 and conveyed onto a developing roller 93. Then, the toner 99 is uniformly applied onto a surface of the developing roller 93 by a developing blade 98 that is held in, contact with the developing roller 93, and charge is applied to the toner 99 by friction charging. The electrostatic latent image is developed with the toner 99 conveyed by the developing roller 93 that is held in contact with the photosensitive drum 91, with the result that the electrostatic latent image is visualized as a toner image.

The visualized toner image on the photosensitive drum is transferred onto an intermediate transfer belt 915, which is supported and driven by an tension roller 913 and an intermediate transfer belt drive roller 914, by a primary transfer roller 912 having a voltage from a primary transfer bias power source applied thereto. Toner images of the respective colors are successively superimposed on each other so as to form a color image on the intermediate transfer belt.

A transfer material 919 is fed into the apparatus by a sheet feed roller and conveyed to between the intermediate transfer belt 915 and a secondary transfer roller 916. A voltage is applied from a secondary transfer bias power source to the secondary transfer roller 916 so that the color image on the intermediate transfer belt 915 is transferred onto the transfer material 919. The transfer material 919 having the color image transferred thereon is subjected to fixing treatment by a fixing unit 918 and delivered out of the apparatus. Thus, a print operation is completed.

On the other hand, the toner remaining on the photosensitive drum without being transferred is scraped with a cleaning blade 95 so as to be accommodated in a waste toner accommodating container 97, and the photosensitive drum 91 thus cleaned repeats the above-mentioned steps. Further, the toner remaining on the primary transfer belt without being transferred is also scraped with a cleaning device 917.

EXAMPLES

Example 1

(1. Preparation of Unvulcanized Rubber Composition)

Respective materials of kinds and in amounts shown in Table 1 below were mixed with a pressure kneader so as to obtain an A kneaded rubber composition. Further, 166 parts by mass of the A kneaded rubber composition and respective materials of kinds and in amounts shown in Table 2 below were mixed with an open roll so as to prepare an unvulcanized rubber composition.

TABLE 1

| Material | Blending amount (part(s) by mass) |
|---|---|
| NBR (trade name: Nipol DN219, manufactured by Zeon Corporation) | 100 |
| Carbon black (trade name: TOKABLACK #7360SB, manufactured by Tokai Carbon Co., Ltd.) | 40 |
| Calcium carbonate (trade name: NANOX #30, manufactured by Maruo Calcium Co., Ltd.) | 20 |
| Zinc oxide (trade name: Zinc Oxide No. 2; manufactured by Sakai Chemical Industry Co., Ltd.) | 5 |
| Stearic acid (trade name: Stearic acid S; manufactured by Kao Corporation) | 1 |

TABLE 2

| | Material | Blending amount (part(s) by mass) |
|---|---|---|
| Crosslinking agent | Sulfur | 1.2 |
| Vulcanization accelerator | Tetrabenzylthiuram disulfide (trade name: TBZTD, manufactured by Sanshin Chemical Industry Co., Ltd.) | 4.5 |

(2. Production of Electroconductive Support)

[2-1. Electroconductive Mandrel]

A round bar made of free-cutting steel having a total length of 252 mm, an outer diameter of 6 mm, and a surface subjected to electroless nickel plating was prepared. Next, an adhesive (trade name: Metaloc U-20, manufactured by Toyokagaku Kenkyusho Co., Ltd.) was applied to an entire periphery of the round bar within a range of 230 mm, excluding both ends each having a length of 11 mm, with a roll coater. In this example, the round bar coated with the adhesive was used as an electroconductive mandrel.

[2-2. Electroconductive Resin Layer]

Next, a die having an inner diameter of 12.5 mm was mounted on a tip end of an extruder equipped with a crosshead having a supply mechanism of the electroconductive mandrel and a discharge mechanism of an unvulcanized rubber roller. Each temperature of the extruder and the crosshead was adjusted to 80° C., and the conveyance speed of the electroconductive mandrel was adjusted to 60 mm/sec. Under the conditions, the unvulcanized rubber composition was supplied through the extruder, and an outer periphery of the electroconductive mandrel was covered with the unvulcanized rubber composition in the crosshead, with the result that an unvulcanized rubber roller was obtained. Next, the unvulcanized rubber roller was put in a hot-air vulcanization furnace at a temperature of 170° C. and heated for 60 minutes so as to vulcanize the unvulcanized rubber composition. Thus, a roller having an electroconductive resin layer formed on an outer periphery of the electroconductive mandrel was obtained. After that, both ends each having a length of 10 mm of the electroconductive resin layer were cut off so that the length of the electroconductive resin layer portion in a longitudinal direction became 231 mm. Finally, a surface of the electroconductive resin layer was polished with a rotary grindstone. Accordingly, an electroconductive support A1 having a diameter of 8.4 mm at each position of 90 mm from a center portion to both ends and a diameter of 8.5 mm at a center portion was obtained.

(3. Formation of Surface Layer)

Figure 10:
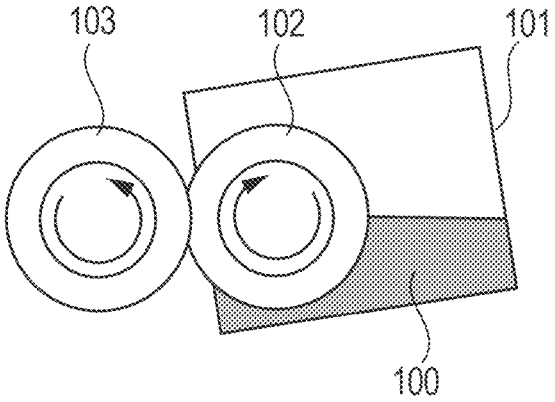
FIG. 10 is an explanatory view of an application device to be used for forming a surface layer according to the present invention.

FIG. 10 is a schematic illustration of an application device configured to apply particles to form a surface layer. The application device includes particles 100, a particle storage unit 101, a particle application roller 102, and a member to which particles are applied 103, and an electroconductive support A1 is installed as the member to which particles are applied 103. Thus, a surface layer can be formed.

The particle application roller 102 is an elastic sponge roller having a foamed layer formed on an outer periphery of an electroconductive cored bar. The particle application roller 102 is arranged so as to form a predetermined contact region (nip part) in a portion opposed to the member to which particles are applied 103 and is configured to rotate in a direction of the arrow (clockwise direction) of FIG. 10. In this case, the particle application roller 102 is held in contact with the member to which particles are applied 103 with a predetermined intrusion amount, that is, a recess caused in the particle application roller 102 by the member to which particles are applied 103. When the particles are applied, the particle application roller 102 and, the member to which particles are applied 103 rotate so as to move in opposite directions in the contact region. With this operation, the particle application roller 102 applies the particles to the member to which particles are applied 103, and the particles on the member to which particles are applied 103 are removed.

As the particles 100 for forming the surface layer, non-crosslinked acrylic particles (Type: MX-300, manufactured by Soken Chemical & Engineering Co., Ltd.) were applied to the electroconductive support A1 by driving and rotating the particle application roller 102 at 90 rpm and the electroconductive support A1 at 100 rpm for 10 seconds, to thereby obtain an unheated electroconductive member al.

Then, the unheated electroconductive member al was loaded into an oven and heated at a temperature of 140° C. for 3 hours to obtain an electroconductive member A1.

(4. Evaluation of Characteristics)

The electroconductive member A1 according to this example was subjected to the following evaluation test. The evaluation results are shown in Table 7. Note that, in the case where the electroconductive member is a roller-shaped electroconductive member, an x-axis direction, a y-axis direction, and a z-axis direction respectively refer to the following directions.

The x-axis direction refers to a longitudinal direction of a roller (electroconductive member).

The y-axis direction refers to a tangential direction in a transverse cross-section (that is, a circular cross-section) of the roller (electroconductive member) orthogonal to an x-axis.

The z-axis direction refers to a diameter direction in the transverse cross-section of the roller (electroconductive member) orthogonal to the x-axis. Further, an "xy-plane" refers to a plane orthogonal to the z-axis, and a "yz-cross-section" refers to a cross-section orthogonal to the x-axis.

[4-1. Confirmation of Skeleton that is Three-Dimensionally Continuous and Pore that Communicates in Thickness Direction]

Whether or not the porous body had a co-continuous structure was confirmed by the following method. A razor was brought into contact with the surface layer of the electroconductive member A1 so that a segment having a length of 250 μm each in an x-axis direction and in a y-axis direction and having a depth of 700 μm including the electroconductive support A1 in a z-axis direction was cut out. Then, the segment was subjected to three-dimensional reconstruction with an X-ray CT inspection device (trade name: TOHKEN-SkyScan 2011 (radiation source: TX-300), manufactured by Mars Tohken X-ray Inspection Co., Ltd.). Two-dimensional slice images (parallel to an xy-plane) were cut from the three-dimensional image thus obtained at an interval of 1 μm with respect to a z-axis. Then, the slice images were binarized so that a skeleton portion and a pore portion were identified. The slice images were checked successively with respect to the z-axis, and thus it was confirmed that the skeleton portion was three-dimensionally continuous and the pore portion communicated in a thickness direction.

[4-2. Evaluation of Through Holes]

The through holes of the surface layer were evaluated as follows. Platinum was deposited from the vapor on a surface of the segment so as to obtain a deposited segment. Then, the surface of the deposited segment was photographed from the z-axis direction at a magnification of 1,000 times with a scanning electron microscope (SEM) (trade name: S-4800, manufactured by Hitachi High-Technologies Corporation) so as to obtain a surface image.

Next, in the surface image, 59 dividing lines were created vertically and 59 dividing lines were created horizontally at an interval of 2.5 μm in a region measuring 150 μm per side to form a total of 3,600 squares to acquire an evaluation image by image processing software (product name: Image-pro plus, manufactured by Media Cybernetics Corporation). Then, in the evaluation image, the number of squares including the surface of the electroconductive support in the 3,600 grids (squares) was visually counted. The evaluation was carried out based on the following criteria. The evaluation results are shown in Table 8A and Table 8B. Note that, the term "squares including the surface of the electroconductive support" as used herein refers to "squares in which the surface of the electroconductive support can be visually confirmed."

A: The total number of the squares including the surface of the electroconductive support is 5 or less.

B: The total number of the squares including the surface of the electroconductive support is 6 or more and 25 or less.

C: The total number of the squares including the surface of the electroconductive support is 26 or more and 100 or less.

D: The total number of the squares including the surface of the electroconductive support is 101 or more.

[4-3. Evaluation of Non-Electroconductivity of Surface Layer]

The non-electroconductivity of the surface layer (porous body) was evaluated as follows. The volume resistivity of the surface layer was measured in a contact mode through use of a scanning probe microscope (SPM) (trade name: Q-Scope 250, manufactured by Quesant Instrument Corporation).

First, a skeleton forming the porous body of the surface layer was collected from the electroconductive member A1 with tweezers, and a part of the collected skeleton was placed on a metal plate made of stainless steel so as to obtain a measurement segment. Next, a portion that was held in direct contact with the metal plate was selected, and a cantilever of the SPM was brought into contact with the portion. A voltage of 50 V was applied to the cantilever so that a current value was measured. Then, the surface shape of the measurement segment was observed with the SPM so as to obtain a height profile, and the thickness of the measurement portion was calculated from the obtained height profile. Further, the area of a concave part of the portion that was in held in contact with the cantilever was calculated from the surface shape observation result. The volume resistivity was calculated from the thickness and the area of the concave part and defined as the volume resistivity of the surface layer.

The electroconductive member A1 was equally divided into 10 regions in a longitudinal direction. A skeleton forming the porous body of the surface layer was collected from any one point in each of the 10 regions (10 points in total) with tweezers and subjected to the above-mentioned measurement. An average value of the measured volume resistivities was defined as the volume resistivity of the surface layer. The evaluation results are shown in Table 8.

[4-4. Evaluation of Amount of Charge-Up of Surface Layer]

A surface potential of an electroconductive member (charging member) caused by corona discharge was measured through use of a charge quantity measurement device (trade name: DRA-2000L, manufactured by Quality Engineering Associates (QEA), Inc.). Specifically, a corona discharger of the charge quantity measurement device was arranged so that a gap between a grid portion thereof and the surface of the electroconductive member A1 became 1 mm. Then, a voltage of 8 kV was applied to the corona discharger to cause discharge, to thereby charge the surface of the electroconductive member. After the completion of discharge, a surface potential of the electroconductive member after an elapse of 10 seconds was measured.

[4-5. Evaluation of Particle Diameter]

The average value D1 of circle-equivalent diameters of particles was evaluated as follows. The surface layer formed on the surface of the segment was crushed with tweezers while the surface layer was observed with a stereoscopic microscope at a magnification of 1,000, and the particles were decomposed into each particle so that the particles were not deformed on the surface of the electroconductive support. Next, platinum was deposited from the vapor onto the resultant to obtain a deposited segment. Then, the surface of the deposited segment was photographed at a magnification of 1,000 through use of a scanning electron microscope (SEM) (trade name: S-4800, manufactured by Hitachi High-Technologies Corporation) from the z-axis direction to acquire a surface image.

Then, the surface image was processed by image processing software (trade name: Image-pro plus, manufactured by Media Cybernetics Corporation) so that the particles became white and the surface of the electroconductive support became black, and circle-equivalent diameters of any 50 particles were measured by a counting function. The electroconductive member A1 was equally divided into 10 regions in a longitudinal direction, and the obtained 10 regions were subjected to the above-mentioned measurement to measure circle-equivalent diameters of any total of 500 particles. An arithmetic average of the 500 circle-equivalent diameters was defined as the circle-equivalent diameter D1 of the particles. The evaluation results are shown in Table 8A and Table 8B.

[4-6. Evaluation of Neck Diameter]

The average value D2 of circle-equivalent diameters of cross-sections of necks was evaluated as follows. A three-dimensional image was constructed in the same manner as in the [4-1. Confirmation of skeleton that is three-dimensionally continuous and pore that communicates in thickness direction] section, and circle-equivalent diameters of 20 necks in the three-dimensional image were measured.

The above-mentioned operation was performed at any one point in each of 10 regions obtained by equally dividing the electroconductive member A1 into 10 regions in a longitudinal direction (200 points in total), and an arithmetic average of the circle-equivalent diameters of the 200 necks was defined as the circle-equivalent diameter D2 of the necks.

Then, a ratio D2/D1 of the circle-equivalent diameter D1 and the circle-equivalent diameter D2 of the necks was calculated as a neck ratio R. The evaluation results are shown in Table 8A and Table 8B.

[4-7. Evaluation of Thickness of Surface Layer]

The thickness of the surface layer was evaluated as follows.

First, as described in the [4-1. Confirmation of skeleton that is three-dimensionally continuous and pore that communicates in thickness direction] section, a razor was brought into contact with the surface layer of the electroconductive member A1 so that a segment having a length of 250 μm each in the x-axis direction and the y-axis direction and having a depth of 700 μm including the electroconductive support in the z-axis direction was cut out.

Images of slice surfaces (slice images) parallel to the surface of the electroconductive support are successively acquired from the segment at an interval of 1 μm from the upper portion (upper direction of the z-axis) of the surface layer to the electroconductive substrate along the z-axis through use of an X-ray CT inspection device (trade name: TOHKEN-SkyScan2011 (radiation source: TX-300), manufactured by Mars Tohken X-ray Inspection Co., Ltd.).

Note that, in order to specify the outermost surface of the surface layer on a side away from the electroconductive substrate, the slice images are successively acquired from the upper portion of the surface layer in which the surface layer does not definitely exist toward the electroconductive substrate. With this, a slice surface in which the ratio of the skeleton portion in the slice image reaches 2% or more for the first time, calculated by a procedure described later, can be specified.

Further, in order to specify the outermost surface of the surface layer on a side close to the electroconductive substrate, slice images are successively acquired from the portion of the electroconductive substrate toward the upper portion (upper direction of the z-axis) of the surface layer. With this, a slice surface in which the ratio of the skeleton portion in the slice image reaches 2% or more for the first time on the side close to the electroconductive substrate of the surface layer can be specified.

A two-dimensional slice image acquired by the X-ray CT measurement is binarized by an Ohtsu method (determination analysis method) to identify a skeleton portion and a pore portion. In each binarized slice image, the ratio of the skeleton portion is converted into numerical values, and the numerical values are confirmed from the electroconductive support side to the surface layer side to calculate the ratio of the skeleton portion. Then, as described above, a slice surface from which the slice image, in which the ratio of the skeleton portion reaches 2% or more for the first time, is obtained on the side farthest from the electroconductive substrate when the measurement is started from the upper portion of the surface layer is considered as the outermost surface of the surface layer on the side away from the electroconductive substrate.

Further, a slice surface from which the slice image, in which the ratio of the skeleton portion reaches 2% or more for the first time, is obtained on the side close to the electroconductive substrate when the measurement is started from the electroconductive substrate is considered as the outermost surface of the surface layer on the side close to the electroconductive substrate.

Note that, the above-mentioned operation is performed at any one point in each of 10 regions obtained by equally dividing the electroconductive member A1 into 10 regions in a longitudinal direction (10 points in total), and an arithmetic average thereof was defined as the thickness of the surface layer. The evaluation results are shown in Table 8A and Table 8B.

[4-8. Evaluation of Porosity of Surface Layer]

The porosity of the surface layer was measured by the following method. A ratio of the pore portion in a three-dimensional image obtained by the above-mentioned X-ray CT evaluation was converted into a numerical value so as to obtain the porosity of the surface layer. The above-mentioned operation was performed at any one point in each of 10 regions (10 points in total) obtained equally dividing the electroconductive member A1 into the 10 regions in a longitudinal direction, and an average value of the measured porosities was defined as the porosity of the surface layer. The evaluation results are shown in Table 8A and Table 8E.

(5. Evaluation of Image)

The electroconductive member A1 was subjected to the following evaluation test.

[5-1. Evaluation of Image Quality]

The effect of suppressing an image defect (black spot) derived from the non-electroconductive skeleton in an initial stage (before a durability test (repeated use test)) of the electroconductive member A1 was confirmed by the following method. As an electrophotographic apparatus, an electrophotographic laser printer (trade name: Laserjet CP4525dn, manufactured by Hewlett-Packard Development Company, L.P.) was prepared. Note that, in order to put the electroconductive member in a more severe evaluation environment, the laser printer was remodeled so that the number of sheets to be output per unit time was 50 sheets/min in terms of A4-size sheets. In this case, the output speed of a recording medium was set to 300 mm/sec, and the image resolution was set to 1,200 dpi.

Next, the electroconductive member A1 was mounted as a charging roller on a toner cartridge dedicated to the laser printer. The toner cartridge was loaded on the laser printer, and a half-tone image (image in which lateral lines were drawn at a width of one dot and an interval of two dots in a direction perpendicular to the rotation direction of the photosensitive drum) was output in an L/L environment (environment at a temperature of 15° C. and a relative humidity of 10%).

In this case, the voltage applied between the charging roller and the electrophotographic photosensitive member was set to −1,000 V. The evaluation results are shown in Table 8A and Table 8B.

[Evaluation of Image Defect Derived from Non-Electroconductive Skeleton]

A: No black spot image is observed.

B: A slight white line in the shape of a black spot is partially observed.

C: A slight white line in the shape of a black spot is observed over an entire surface.

D: A black line in the shape of a streak is observed and conspicuous.

[5-2-1. Evaluation of Void Image]

The image acquired in the [5-1. Evaluation of image quality] section was visually observed, and the presence/absence of image unevenness (void image) caused by local strong discharge from the charging member was observed.

Next, the output and visual evaluation of electrophotographic images were repeated in the same manner as described above, except for changing the applied voltage in decrements of 10 V from −1,010 V, −1,020 V, −1,030 V, . . . . Then, the applied voltage was measured at a time when an electrophotographic image, in which image unevenness (void image) caused by local strong discharge from the charging member was able to be confirmed visually, was formed. The applied voltage in this case was described in Table 8A and Table 8B as a void image generation voltage before the durability test.

[5-2. Evaluation of Image Defect Derived from Adhesion of Dirt after Durability Test]

The effect of suppressing an image defect (white spot, white band) derived from the adhesion of dirt after a durability test of the electroconductive member A1 was confirmed by the following method. In the image acquired by the evaluation of the lateral streak, an image defect was confirmed and evaluated based on the following criteria. The evaluation results are shown in Table 8A and Table 8B.

[Evaluation of Image Defect Derived from Adhesion of Dirt]

A: No image defect derived from the adhesion of dirt is observed.

B: A slight image defect (white spot) derived from the adhesion of dirt is partially observed.

C: A slight image defect (white spot) derived from the adhesion of dirt is observed over an entire surface.

D: An image defect (white spot) derived from the adhesion of dirt is observed over the entire surface, and is observed as a vertical streak.

Example 2 to Example 10

Electroconductive members A2 to A10 were produced and evaluated in the same manner as in Example 1 except that the particle material and the application conditions and heating conditions of the particles were changed as shown in Table 3 so that the structures of the surface layers were changed. The evaluation results are shown in Table 8A and Table 8B,

TABLE 3

| | Surface layer | | | | | | | |
|---|---|---|---|---|---|---|---|---|
| | | | | Production condition | | | | |
| | Material | | | Number of rotations of particle application | Number of rotations of electroconductive | Application | Heating | Heating |
| Example No. | Kind of material | Type | Manufacturer | roller (rpm) | support (rpm) | time (seconds) | temperature (° C.) | time (hours) |
| Example 2 | PMMA | MP-300 | Soken Chemical & Engineering Co., Ltd. | 90 | 50 | 3 | 140 | 3 |
| Example 3 | PMMA | MP-300 | Soken Chemical & Engineering Co., Ltd. | 90 | 90 | 5 | 140 | 3 |
| Example 4 | PMMA | MP-300 | Soken Chemical & Engineering Co., Ltd. | 90 | 100 | 30 | 140 | 3 |
| Example 5 | PMMA | MP-1451 | Soken Chemical & Engineering Co., Ltd. | 90 | 100 | 15 | 140 | 3 |
| Example 6 | PMMA | MP-1451 | Soken Chemical & Engineering Co., Ltd. | 90 | 120 | 30 | 140 | 3 |
| Example 7 | PMMA | MP-80H3wT | Soken Chemical & Engineering Co., Ltd. | 90 | 100 | 13 | 140 | 3 |

TABLE 3-continued

| | Surface layer | | | | | | | |
|---|---|---|---|---|---|---|---|---|
| | | | | Production condition | | | | |
| | Material | | | Number of rotations of particle application | Number of rotations of electroconductive | Application | Heating | Heating |
| Example No. | Kind of material | Type | Manufacturer | roller (rpm) | support (rpm) | time (seconds) | temperature (° C.) | time (hours) |
| Example 8 | PMMA | MP-1000 | Soken Chemical & Engineering Co., Ltd. | 90 | 100 | 8 | 140 | 3 |
| Example 9 | PMMA | MP-2000 | Soken Chemical & Engineering Co., Ltd. | 90 | 100 | 5 | 140 | 3 |
| Example 10 | PMMA | MP-300 | Soken Chemical & Engineering Co., Ltd. | 90 | 100 | 40 | 140 | 3 |

Example 11

An electroconductive member A11 was produced and evaluated in the same manner as in Example 1 except that PAN particles (trade name: TAFTIC A20, manufactured by Toyobo Co., Ltd.) were used as the particles, and the heating temperature was set to 250° C. and the heating time was set to 12 hours to make the particle shape irregular. The evaluation results are shown in Table SA and Table 8B.

Example 12 to Example 14

Electroconductive members A12 to A14 were produced and evaluated in the same manner as in Example 1 except that the heating conditions of the surface layer were changed as shown in Table 4 to change the diameter of the neck. The evaluation results are shown in Table 8A and Table 8B.

TABLE 4

| | Heating temperature (° C.) |
|---|---|
| Example 12 | 160 |
| Example 13 | 150 |
| Example 14 | 120 |

Example 15

An electroconductive member A15 was produced and evaluated in the same manner as in Example 1 except that the addition amount of carbon black serving as a conductive agent to be dispersed in the unvulcanized rubber composition was changed to 80 phr. The evaluation results are shown in Table 8A and Table 8B. Note that, "phr" refers to the addition amount (parts by mass) with respect to 100 parts by mass of the unvulcanized rubber composition.

Example 16

An electroconductive member A16 was produced and evaluated in the same manner as in Example 1 except that the A kneaded rubber composition was prepared through use of a material (material containing epichlorohydrin) shown in Table 5-1 as a material for an unvulcanized rubber, and 166 parts by mass of the A kneaded rubber composition and respective materials of kinds and in amounts shown in Table 5-2 below were mixed with an open roll to prepare an unvulcanized rubber composition. The evaluation results are shown in Table 8A and Table 8B.

TABLE 5-1

| Material | Blending amount (part(s) by mass) |
|---|---|
| Epichlorohydrin-ethylene oxide-ally glycidyl ether terpolymer (GECO) (trade name: EPICHLOMER CG-102; manufactured by Daiso Co., Ltd. (new company name: Osaka Soda Co., Ltd.) | 100 |
| Zinc oxide (Zinc Oxide No. 2; manufactured by Sakai Chemical Industry Co., Ltd.) | 5 |
| Calcium carbonate (trade name: Silver-W; manufactured by Shiraishi Calcium Kaisha, Ltd.) | 35 |
| Carbon black (trade name: Thermax Flow Form N990; manufactured by Cancarb) | 0.5 |
| Stearic acid (trade name: Stearic acid S; manufactured by Kao Corporation) | 2 |
| Adipic acid polyester (trade name: POLYCIZER W305ELS; manufactured by Nippon Ink Chemical Industry Co., Ltd.) | 10 |
| Quaternary ammonium salt (trade name: ADK CIZER LV70; manufactured by Asahi Denka Co., Ltd.) | 1 |

TABLE 5-2

| | |
|---|---|
| sulfur (trade name: Sulfax PMC; manufactured by Tsurumi Chemical Industries Co. Ltd.) | 1 |
| Dibenzothiazyl disulfide (trade name: NOCCELER DM; manufactured by Ouchi Shinko Chemical Industrial Co., Ltd.) | 1 |
| Tetramethylthiuram monosulfide (trade name: NOCCELER TS; manufactured by Ouchi Shinko Chemical Industrial Co., Ltd.) | 1 |

Example 17

An electroconductive member A17 was produced and evaluated in the same manner as in Example 1 except that an electroconductive resin layer was further formed on an outer peripheral surface of the electroconductive support A1 in accordance with the following method. The evaluation results are shown in Table 8A and Table 8B.

First, methyl isobutyl ketone was added to a caprolactone-modified acrylic polyol solution so as to adjust the solid content to 10 mass %. Then, a mixed solution was prepared by using materials shown in Table 6 below with respect to 1,000 parts by mass (solid content: 100 parts by mass) of the acrylic polyol solution. In this case, a mixture of blocked HDI and blocked IPDI was "NCO/OH=1.0",

TABLE 6

| Material | Blending amount (part(s) by mass) |
|---|---|
| Caprolactone-modified acrylic polyol solution (trade name: PLACCEL DC2016; manufactured by Daicel Chemical Industries, Ltd.) | 100 (Solid content) |
| Carbon black (trade name: MA230; manufactured by Mitsubishi Chemical Corporation) | 15 |
| Acicular rutile-type titanium oxide fine particles (trade name: SMT150IB; manufactured by Tayca Corporation) | 35 |
| Modified dimethylsilicone oil (trade name: SH28PA; manufactured by Dow Corning Toray Co., Ltd.) | 0.1 |
| 7:3 mixture of butanone oxime-blocked products of hexamethylene diisocyanate (HDI) and isophorone diisocyanate (IPDI) | 80.14 |
| HDI: trade name: DURANATE TPA-B80E; manufactured by Asahi Kasei Kogyo Co. | |
| IPDI: VESTANAT B1370; manufactured by Evonik Industries | |

Then, 210 g of the above-mentioned mixed solution and 200 g of glass beads having an average particle diameter of 0.8 mm serving as a medium were mixed in a 450 mL glass bottle, and the mixture was pre-dispersed for 24 hours with a paint shaker disperser so as to obtain a paint for forming an electroconductive resin layer.

The electroconductive support A1 was immersed in the paint for forming an electroconductive resin layer so as to be coated with the paint by dip coating, with a longitudinal direction thereof being directed in a vertical direction. The immersion time for dip coating was 9 seconds, and the take-up speed was set to 20 mm/sec as an initial speed and 2 mm/sec as a final speed. The take-up speed was changed linearly with respect to time between the initial speed and the final speed. The coated object thus obtained was air-dried at normal temperature for 30 minutes. Then, the coated object was dried in a hot-air circulating drier set to a temperature of 90° C. for 1 hour and further dried in the hot-air circulating drier set to a temperature of 160° C. for 1 hour.

Example 18

An electroconductive member A18 was produced and evaluated in the same manner as in Example 1 except that only the round bar was used as the electroconductive support. Note that, in order to perform evaluation, the cartridge was changed so that the electroconductive member A18 was brought into contact with the photosensitive drum. The evaluation results are shown in Table 8A and Table 8B.

Example 19

The paint for forming an electroconductive resin layer of Example 16 was applied onto a sheet made of aluminum having a thickness of 200 μm by dip coating under the same condition as that of Example 18 so as to form an electroconductive resin layer on the sheet made of aluminum. Thus, a blade-shaped electroconductive support was produced. Next, a surface layer was formed on an outer peripheral surface of the blade-shaped electroconductive support in the same manner as in Example 1 so as to produce an electroconductive member A19.

The electroconductive member A19 was mounted as a charging blade on the same electrophotographic laser printer as that used for evaluating an image in Example 1 and arranged so as to abut against the photosensitive drum in a forward direction with respect to the rotation direction of the photosensitive drum. Note that, an angle θ formed by a contact point at the abutment point of the electroconductive member A19 with respect to the photosensitive drum and the charging blade was set to 200 from the viewpoint of chargeability. Further, an abutment pressure of the electroconductive member A20 with respect to the photosensitive drum was initially set to 20 g/cm (linear pressure). An image was evaluated under the same conditions as those of Example 1. The evaluation results are shown in Table 8A and Table 8B.

Example 20

An electroconductive member A20 was produced and evaluated in the same manner as in Example 19 except that the electroconductive resin layer was not formed. Note that, for evaluation, in the same manner as in Example 19, the cartridge was changed so that the electroconductive member A20 was brought into contact with the photosensitive drum. The evaluation results are shown in Table 8A and Table 8B.

Example 21 to Example 24

Electroconductive members A21 to A24 were produced and evaluated in the same manner as in Example 1 except that the particle material and the application conditions of the particles were changed as shown in Table 7 to change a resistance. The evaluation results are shown in Table 8A and Table 8B.

TABLE 7

| | Surface layer | | | | | | | |
|---|---|---|---|---|---|---|---|---|
| | | | | Production condition | | | | |
| | Material | | | Number of rotations of particle application | Number of rotations of electroconductive | Application | Heating | Heating |
| Example No. | Kind of material | Type | Manufacturer | roller (rpm) | support (rpm) | time (seconds) | temperature (° C.) | time (hours) |
| Example 21 | Polystyrene | SX-130H | Soken Chemical & Engineering Co., Ltd. | 90 | 110 | 50 | 140 | 3 |
| Example 22 | Polystyrene | SX-130H | Soken Chemical & Engineering Co., Ltd. | 90 | 120 | 40 | 140 | 3 |

TABLE 7-continued

| | Surface layer | | | | | | | |
|---|---|---|---|---|---|---|---|---|
| | | | | Production condition | | | | |
| | Material | | | Number of rotations of particle application | Number of rotations of electroconductive | Application | Heating | Heating |
| Example No. | Kind of material | Type | Manufacturer | roller (rpm) | support (rpm) | time (seconds) | temperature (° C.) | time (hours) |
| Example 23 | Polyurethane | Trade name: Art Pearl MM-120T | Negami Chemical Industrial Co., Ltd | 90 | 100 | 10 | 170 | 3 |
| Example 24 | Polyurethane | Trade name: Art Pearl MM-120T | Negami Chemical Industrial Co., Ltd | 90 | 100 | 50 | 170 | 3 |

Example 25

An electroconductive member A25 was produced and evaluated in the same manner as in Example 1 except that polyacrylic acid ester particles (trade name: Techpolymer ABX-5, manufactured by Sekisui Plastics Co., Ltd.) were used as the particle material, and the heating temperature was changed to 200° C. to change a resistance. The evaluation results are shown in Table 8A and Table 8B.

Example 26

An electroconductive member A26 was produced and evaluated in the same manner as in Example 19 except that silica particles (trade name: sicastar 43-00-303, manufactured by Micromod) were used as the particle material, and the heating temperature was set to 1,000° C. and the heating time was set to 2 hours. The evaluation results are shown in Table 8A and Table 8B.

Example 27

An electroconductive member A27 was produced and evaluated by applying an electroconductive resin layer to the unheated electroconductive member al by the same method as that of Example 17 except that a solid content was set to 1% and carbon black was set to 0 phr with respect to the unheated electroconductive member al. In this case, the electroconductive resin layer serves as a binder resin to form a neck between particles. The evaluation results are shown in Table 8A and Table 8B.

Example 28

An electroconductive member AA1 was obtained by mounting a spacing member (ring having an outer diameter of 8.6 mm, an inner diameter of 6 mm, and a width of 2 mm in an end portion of the electroconductive resin layer) on the electroconductive member A1. Then, a durability test was conducted under an L/L environment through use of the above-mentioned laser printer having the electroconductive member AA1 mounted thereon as a charging roller. The durability test was conducted by repeating an intermittent image forming operation of outputting two sheets of an image, stopping the rotation of the photosensitive drum completely for about 3 seconds, and resuming output of the image, to thereby output 40,000 sheets of an electrophotographic image. In this case, the image was output so that an alphabet letter "E" having a 4-point size was printed to a coverage ratio of 4% with respect to the area of a sheet of an A4 size. The applied voltage between the charging roller and the electrophotographic photosensitive member in this case was set to −1,200 V.

After the durability test, the applied voltage was changed in decrements of 10 V from −1,210 V, −1,220 V, −1,230 V, . . . , and an applied voltage, at which an electrophotographic image that enabled a void image to be confirmed was formed, was measured. The applied voltage in this case was described in Table 8A and Table 8B as a void image generation voltage after the durability test.

TABLE 8A

| | Characteristic evaluation | | | | | | |
|---|---|---|---|---|---|---|---|
| | Square(s) of through hole (square(s)) | Resistance (Ω · cm) | Presence/ absence of neck | Particle shape | Average value D1 of circle-equivalent diameters of particles (μm) | Thickness (μm) | Thickness/ D1 |
| Example 1 | 1 | 1.7 × 10^16 | Present | Sphere | 3.12 | 14 | 4.5 |
| Example 2 | 98 | 2.2 × 10^16 | Present | Sphere | 3.3 | 4.9 | 1.5 |
| Example 3 | 20 | 1.5 × 10^16 | Present | Sphere | 3.5 | 8.1 | 2.3 |
| Example 4 | 2 | 1.0 × 10^16 | Present | Sphere | 3.1 | 45 | 15 |
| Example 5 | 1 | 2.7 × 10^16 | Present | Sphere | 0.15 | 1.1 | 7.3 |
| Example 6 | 0 | 3.2 × 10^16 | Present | Sphere | 0.20 | 16 | 80 |
| Example 7 | 2 | 2.2 × 10^16 | Present | Sphere | 0.9 | 15 | 17 |

TABLE 8A-continued

| | Characteristic evaluation | | | | | | |
|---|---|---|---|---|---|---|---|
| | Square(s) of through hole (square(s)) | Resistance (Ω · cm) | Presence/ absence of neck | Particle shape | Average value D1 of circle-equivalent diameters of particles (μm) | Thickness (μm) | Thickness/ D1 |
| Example 8 | 13 | 1.1 × 10^16 | Present | Sphere | 8.3 | 14 | 1.7 |
| Example 9 | 5 | 1.7 × 10^16 | Present | Sphere | 19 | 49 | 2.6 |
| Example 10 | 1 | 1.9 × 10^16 | Present | Sphere | 3.2 | 70 | 22 |
| Example 11 | 2 | 2.1 × 10^16 | Present | Irregular shape | 3.4 | 16 | 4.8 |
| Example 12 | 1 | 1.7 × 10^16 | Present | Sphere | 3.3 | 15 | 4.6 |
| Example 13 | 5 | 1.2 × 10^16 | Present | Sphere | 3.3 | 16 | 4.9 |
| Example 14 | 4 | 1.3 × 10^16 | Present | Sphere | 3.5 | 15 | 4.2 |
| Example 15 | 2 | 1.9 × 10^16 | Present | Sphere | 3.2 | 14 | 4.3 |
| Example 16 | 3 | 2.7 × 10^16 | Present | Sphere | 3.3 | 15 | 4.5 |
| Example 17 | 1 | 3.1 × 10^16 | Present | Sphere | 3.1 | 16 | 5.2 |
| Example 18 | 1 | 1.8 × 10^16 | Present | Sphere | 3.1 | 16 | 5.2 |
| Example 19 | 5 | 2.7 × 10^16 | Present | Sphere | 3.4 | 14 | 4.1 |
| Example 20 | 4 | 2.0 × 10^16 | Present | Sphere | 3.2 | 14 | 4.3 |
| Example 21 | 0 | 1.1 × 10^14 | Present | Sphere | 0.8 | 3.5 | 4.3 |
| Example 22 | 0 | 2.1 × 10^14 | Present | Sphere | 1.1 | 17 | 15 |
| Example 23 | 3 | 2.3 × 10^14 | Present | Sphere | 2.9 | 16 | 5.6 |
| Example 24 | 1 | 1.7 × 10^14 | Present | Sphere | 2.9 | 51 | 18 |
| Example 25 | 5 | 5.5 × 10^10 | Present | Sphere | 3.5 | 15 | 4.3 |
| Example 26 | 1 | 1.1 × 10^16 | Present | Sphere | 3.2 | 14 | 4.3 |
| Example 27 | 5 | 1.7 × 10^16 | Present | Sphere | 3.2 | 15 | 4.8 |
| Example 28 | 5 | 1.2 × 10^16 | Present | Sphere | 3.1 | 13 | 4.2 |

TABLE 8B

| | Characteristic evaluation | | | | Image evaluation | | |
|---|---|---|---|---|---|---|---|
| | Average value D2 of circle-equivalent diameters of cross-sections of necks (μm) | Circle-equivalent diameter of neck/circle-equivalent diameter of particle | Amount of charge-up (V) | Porosity (%) | Image quality | Void image generation voltage V1 (V) | Dirt |
| Example 1 | 1.72 | 0.55 | 270 | 72 | A | 1,920 | A |
| Example 2 | 2.00 | 0.60 | 100 | 48 | C | 1,250 | C |
| Example 3 | 1.86 | 0.54 | 130 | 55 | A | 1,930 | A |
| Example 4 | 1.86 | 0.61 | 450 | 75 | C | 1,770 | B |
| Example 5 | 0.08 | 0.52 | 120 | 56 | A | 1,800 | A |
| Example 6 | 0.11 | 0.57 | 540 | 51 | A | 1,960 | C |
| Example 7 | 0.42 | 0.48 | 310 | 70 | A | 1,970 | C |
| Example 8 | 4.96 | 0.60 | 120 | 60 | A | 1,780 | A |
| Example 9 | 9.98 | 0.52 | 220 | 62 | C | 1,720 | B |
| Example 10 | 1.71 | 0.53 | 510 | 69 | C | 1,230 | C |
| Example 11 | 1.98 | 0.59 | 280 | 33 | C | 1,960 | A |
| Example 12 | 3.01 | 0.92 | 230 | 35 | B | 1,930 | B |
| Example 13 | 2.27 | 0.69 | 270 | 73 | A | 1,900 | A |
| Example 14 | 0.42 | 0.12 | 220 | 67 | A | 1,700 | A |
| Example 15 | 1.91 | 0.59 | 160 | 73 | A | 1,850 | A |
| Example 16 | 1.89 | 0.57 | 180 | 71 | A | 1,940 | B |
| Example 17 | 1.79 | 0.58 | 280 | 65 | A | 1,940 | B |
| Example 18 | 1.70 | 0.55 | 260 | 70 | A | 2,060 | A |
| Example 19 | 1.71 | 0.50 | 240 | 70 | A | 1,940 | A |

TABLE 8B-continued

| | Characteristic evaluation | | | | Image evaluation | | |
|---|---|---|---|---|---|---|---|
| | Average value D2 of circle-equivalent diameters of cross-sections of necks (μm) | Circle-equivalent diameter of neck/circle-equivalent diameter of particle | Amount of charge-up (V) | Porosity (%) | Image quality | Void image generation voltage V1 (V) | Dirt |
| Example 20 | 1.67 | 0.52 | 220 | 69 | A | 2,060 | A |
| Example 21 | 0.49 | 0.60 | 130 | 52 | A | 1,780 | B |
| Example 22 | 0.61 | 0.55 | 250 | 51 | A | 1,790 | C |
| Example 23 | 1.50 | 0.52 | 150 | 73 | A | 1,730 | B |
| Example 24 | 1.72 | 0.60 | 340 | 70 | C | 1,770 | C |
| Example 25 | 2.02 | 0.58 | 110 | 69 | A | 1,200 | C |
| Example 26 | 1.67 | 0.52 | 180 | 66 | A | 1,990 | B |
| Example 27 | 1.67 | 0.53 | 130 | 31 | B | 1,220 | C |
| Example 28 | 1.72 | 0.56 | 260 | 75 | A | 2,130 | A |

Comparative Example 1

10 phr of non-crosslinked acrylic particles (Type: MX-500, manufactured by Soken Chemical & Engineering Co., Ltd.) were added to and dispersed in the paint for forming an electroconductive resin layer of Example 18, to thereby form an electroconductive resin. Then, an electroconductive member B1 was evaluated in the same manner as in Example 1 without forming the surface layer. The evaluation results are shown in Table 9A and Table 9B.

In this comparative example, the surface layer is not formed, and hence a void image is not suppressed.

Comparative Example 2

An electroconductive member B2 was produced and evaluated in the same manner as in Example 1 except that the surface layer was not heated. The evaluation results are shown in Table 9A and Table 9B.

In this comparative example, a neck was not formed, and hence the amount of charge-up varied to cause an image defect derived from the variation. Further, adhering dirt and charged-up particles fly to the drum electrostatically to break the surface layer. Therefore, a void image cannot be suppressed.

Comparative Example 3

An electroconductive member A12 was produced and evaluated in the same manner as in Example 1 except that the average value D1 of circle-equivalent diameters of particles was increased through use of non-crosslinked acrylic particles (Type: MX-3000, manufactured by Soken Chemical & Engineering Co., Ltd.) as the particles. The evaluation results are shown in Table 9A and Table 9B.

In this comparative example, the average of the circle-equivalent diameters of the particles was as large as 32 μm, and hence the fineness of the pore was decreased to cause an image defect. Further, a surface area was also decreased, and hence the amount of charge-up was low. Thus, dirt was not able to be suppressed.

Comparative Example 4

An electroconductive member B4 was produced and evaluated in the same manner as in Example 1 except that the number of rotations of the electroconductive support A1 was increased to 150 rpm and the application time was shortened to 3 seconds as the particle application conditions. The evaluation results are shown in Table 9A and Table 9B.

In this comparative example, the number of squares including through holes was 200, and hence the through holes in the surface layer appeared as an image defect.

Comparative Example 5

An electroconductive member B5 was produced and evaluated in the same manner as in Example 1 except that the surface layer was heated at 200° C. for 3 hours. The evaluation results are shown in Table 9A and Table 9B.

In this comparative example, the particles were melted, and an insulating surface layer film was formed. Therefore, an image was not able to be evaluated due to a charging defect.

Comparative Example 6

An electroconductive member B6 was produced and evaluated in the same manner as in Example 1.9 except that carbon particles (PC1020, manufactured by Nippon Carbon Co., Ltd.) were used as the particles, and the heating temperature was changed to 800° C. and the heating time was changed to 12 hours. The evaluation results are shown in Table 9A and Table 9B.

In this comparative example, the surface layer cannot be charged up due to its low electric resistivity, and hence a void image cannot be suppressed.

TABLE 9A

| | Characteristic evaluation | | | | | | |
|---|---|---|---|---|---|---|---|
| | Square(s) of through hole (square(s)) | Resistance (Ω · cm) | Presence/ absence of neck | Particle shape | Average value D1 of circle-equivalent diameters of particles (μm) | Thickness (μm) | Thickness/ D1 |
| Comparative Example 1 | — | — | — | — | — | — | — |
| Comparative Example 2 | 10 | 1.3 × 10^16 | Absent | Sphere | 3.2 | 15 | 4.7 |
| Comparative Example 3 | 5 | 1.2 × 10^16 | Present | Sphere | 32 | 48 | 1.5 |
| Comparative Example 4 | 200 | 2.3 × 10^16 | Present | Sphere | 3.2 | 4.2 | 1.3 |
| Comparative Example 5 | — | 2.5 × 10^16 | — | — | — | 16 | — |
| Comparative Example 6 | 7 | 1.5 × 10^16 | Present | Sphere | 5.1 | 14 | 2.7 |

TABLE 9B

| | Characteristic evaluation | | | | Image evaluation | | |
|---|---|---|---|---|---|---|---|
| | Average value D2 of circle-equivalent diameters of cross-sections of necks (μm) | Circle-equivalent diameter of neck/circle-equivalent diameter of particle | Amount of charge-up (V) | Porosity (%) | Image quality | Void image generation voltage V1 (V) | Dirt |
| Example 1 | — | — | 0 | 0 | A | 1,000 | D |
| Example 2 | — | — | 270 | 45 | C | 1,220 | D |
| Example 3 | 19.32 | 0.60 | 150 | 32 | D | 1,250 | D |
| Example 4 | 1.92 | 0.61 | 100 | 65 | D | 1,230 | C |
| Example 5 | — | — | 260 | 0 | — | — | — |
| Example 6 | 2.65 | 0.52 | 20 | 72 | B | 1,000 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a national phase of PCT Application No. PCT/JP2016/060284 filed Mar. 23, 2016, which in turn claims the benefit of Japanese Patent Application No. 2015-066841, filed Mar. 27, 2015, which are hereby incorporated by reference herein in their entirety.

REFERENCE SIGNS LIST

10 charging member
11 photosensitive drum
12 dirt
13 power source
14 earth
21 surface layer
22 cored bar
23 electroconductive resin layer
30 surface layer
31 electroconductive support
32 photosensitive drum
33 ion having positive polarity
34 negative charge
41 particle
42 neck
70 electroconductive member
71 spacing member
72 electroconductive mandrel
81 photosensitive drum
82 charging roller
83 developing roller
69
84 toner supply roller
85 cleaning blade
86 toner container
87 waste toner container
88 developing blade
89 toner
810 stirring blade
91 photosensitive drum
92 charging roller
93 developing roller
94 toner supply roller
95 cleaning blade
96 toner container
97 waste toner accommodating container
98 developing blade
99 toner
910 stirring blade
911 exposure light
912 primary transfer roller
913 tension roller

914 intermediate transfer belt drive roller
915 intermediate transfer belt
916 secondary transfer roller
917 cleaning device
918 fixing unit
919 transfer material
100 particle
101 particle storage unit
102 particle application roller
103 member to which particles are applied

The invention claimed is:

1. An electroconductive member for electrophotography, comprising:

an electroconductive support; and a surface layer on the electroconductive support, wherein the surface layer comprises a skeleton that is three-dimensionally continuous and a pore that communicates in a thickness direction, wherein, when any region measuring 150 μm per side of a surface of the surface layer is photographed and equally divided into 60 parts in a vertical direction and 60 parts in a horizontal direction to form 3,600 squares, a number of squares including through holes is 100 or less, wherein the skeleton is non-electroconductive, and wherein the skeleton comprises a plurality of particles connected to each other through a neck, and an average value D1 of circle-equivalent diameters of the particles is 0.1 μm or more and 20 μm or less.

2. An electroconductive member for electrophotography according to claim 1, wherein an average value D2 of circle-equivalent diameters of cross-sections of the neck is 0.1 time or more and 0.7 time or less of the average value D1.

3. An electroconductive member for electrophotography according to claim 1, wherein the surface layer has a thickness of 1 μm or more and 50 μm or less.

4. An electroconductive member for electrophotography according to claim 1, wherein the surface layer has a volume resistivity of $1\times10^{10}$ Ω·cm or more and $1\times10^{17}$ Ω·cm or less.

5. An electroconductive member for electrophotography according to claim 1, wherein the surface layer has a porosity of 20% or more and 80% or less.

6. An electroconductive member for electrophotography according to claim 1, wherein the surface layer comprises a porous body formed by heating a film of deposited particles to fuse the particles.

7. An electroconductive member for electrophotography according to claim 1, further comprising a rigid structure configured to protect the surface layer.

8. A process cartridge, which is removably mounted onto a main body of an electrophotographic apparatus, the process cartridge comprising an electroconductive member for electrophotography, comprising:

an electroconductive support; and a surface layer on the electroconductive support, wherein the surface layer comprises a skeleton that is three-dimensionally continuous and a pore that communicates in a thickness direction, wherein, when any region measuring 150 μm per side of a surface of the surface layer is photographed and equally divided into 60 parts in a vertical direction and 60 parts in a horizontal direction to form 3,600 squares, a number of squares including through holes is 100 or less, wherein the skeleton is non-electroconductive, and wherein the skeleton comprises a plurality of particles connected to each other through a neck, and an average value D1 of circle-equivalent diameters of the particles is 0.1 μm or more and 20 μm or less.

9. An electrophotographic apparatus, comprising an electroconductive member for electrophotography, comprising:

an electroconductive support; and a surface layer on the electroconductive support, wherein the surface layer comprises a skeleton that is three-dimensionally continuous and a pore that communicates in a thickness direction, wherein, when any region measuring 150 μm per side of a surface of the surface layer is photographed and equally divided into 60 parts in a vertical direction and 60 parts in a horizontal direction to form 3,600 squares, a number of squares including through holes is 100 or less, wherein the skeleton is non-electroconductive, and wherein the skeleton comprises a plurality of particles connected to each other through a neck, and an average value D1 of circle-equivalent diameters of the particles is 0.1 μm or more and 20 μm or less.

* * * * *